US006348896B2

(12) United States Patent
Takagi et al.

(10) Patent No.: US 6,348,896 B2
(45) Date of Patent: Feb. 19, 2002

(54) ANTENNA DEVICE

(75) Inventors: Naoyuki Takagi, Joyo; Masahiro Ohara, Katano, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/734,580

(22) Filed: Dec. 13, 2000

(30) Foreign Application Priority Data

Dec. 16, 1999 (JP) ..... 11-357237

(51) Int. Cl.[7] ..... H01Q 1/24
(52) U.S. Cl. ..... 343/702; 343/895
(58) Field of Search ..... 343/702, 718, 343/872, 895; 455/90

(56) References Cited

U.S. PATENT DOCUMENTS 4,890,114 A 12/1989 Egashira ..... 343/702
5,828,343 A 10/1998 MacDonald, Jr. et al. .. 343/702
6,052,089 A 4/2000 Eggleston ..... 343/702
6,075,487 A 6/2000 Ito ..... 343/702
6,100,852 A 8/2000 Calearo ..... 343/715
6,181,950 B1 * 1/2001 Mendolia ..... 455/550
6,215,446 B1 * 4/2001 Sullivan et al. ..... 343/702

* cited by examiner

*Primary Examiner*—Don Wong
*Assistant Examiner*—James Clinger
(74) *Attorney, Agent, or Firm*—Wenderoth, Lind & Ponack, L.L.P.

(57) ABSTRACT

Insulating-resin-made attachment part 13A is equipped with connection terminal 10 electrically connected to antenna element 3, and connection terminal 10 is directly connected to a prescribed circuit of a radio machine. As a mounting means to the radio machine, snap part 9 having a metal part projecting out of the sidewall of attachment part 13A is disposed.

37 Claims, 20 Drawing Sheets

ANTENNA DEVICE

FIELD OF THE INVENTION

The present invention relates to an antenna device mainly used for a radio machine for mobile communication such as a portable telephone.

BACKGROUND OF THE INVENTION

Recently, demand for a radio machine for mobile communication such as a portable telephone has sharply increased. Service of text information or the like has been added to functions of the radio machine and variety of the functions has been increased. For responding to the variety, improved performance has been required for the radio machine. This market situation requires antenna device installed in the radio machine to be lightened and have higher sensitivity and a wider band.

An antenna device installed in a conventional radio machine is described hereinafter with reference to FIG. 22.

FIG. 22 is a perspective view illustrating a conventional antenna device and a mounting part with which this antenna device is mounted to a radio machine.

As shown in FIG. 22, conventional antenna device 5 comprises the following elements:

- fitting metal 1 for attaching the antenna device to a radio machine body;
- core part 2 fixed over fitting metal 1;
- antenna element 3 placed on the outer periphery of core part 2; and
- top cover 4 made of insulating resin for covering core 2 and antenna element 3.

Fitting metal 1 is made of metal and includes screw part 1A and recessed part 1B. Core part 2 is made of insulating resin such as acrylonitrile-butadiene-styrene (ABS). Antenna element 3 comprises winding part 3A formed by spirally winding a copper wire or a copper alloy wire on the outer periphery of core part 2, and antenna element's lower part 3B under winding part 3A. Antenna element's lower part 3B is fixed to the outer periphery of recessed part 1B of fitting metal 1. In this structure, antenna element 3 and fitting metal 1 are electrically connected.

Top cover 4 is made of insulating resin in order to cover core part 2 and antenna element 3.

Radio machine 6 has a tubular part for receiving antenna device 5 in its upper part, and metallic female screw 7 is fixed to the inside of the tubular part.

Connection terminal 8 is electrically connected to the metallic female screw 7. An end of connection terminal 8 is electrically connected to a prescribed circuit part over a wiring board (not shown in FIG. 22) placed in radio machine 6.

Conventional antenna device 5 is mechanically and electrically mounted to radio machine 6 by fastening screw part 1A of fitting metal 1 into metallic female screw 7.

When a given radio wave goes into antenna element 3, antenna element 3 induces high frequency current corresponding to the radio wave. The high frequency current induced by antenna element 3 flows to the prescribed circuit part placed in radio machine 6 through fitting metal 1, metallic female screw 7, and connection terminal 8. Thus, radio machine 6 can receive information carried by the radio wave. Radio machine 6 generates high frequency current corresponding to information to be transmitted in the prescribed circuit part, and transmits the generated high frequency current as radio wave through antenna element 3.

Conventional antenna device 5 has a structure where electric connection is obtained by fastening fitting metal 1 into female screw 7 of radio machine 6. Therefore, fitting metal 1 of antenna device 5 and female screw 7 of radio machine 6 must be made of metal. As a result, masses of antenna device 5 and radio machine 6 inconveniently increase.

In addition, in the conventional structure, the high frequency current induced at antenna element 3 of antenna device 5 flows to the prescribed circuit part placed in radio machine 6 through fitting metal 1, female screw 7, and connection terminal 8 in a state where antenna device 5 is mounted to radio machine 6. This structure includes many connections for guiding the high frequency current to the prescribed circuit. Electrical loss of the high frequency current is apt to occur at the connections, and may affect receiving sensitivity of radio machine 6.

SUMMARY OF THE INVENTION

The object of the present invention is to solve the conventional problems discussed above, and to provide an antenna device that is light, has less electrical loss of induced high frequency current, and can be easily and strongly mounted to a radio machine.

For attaining the object, the antenna device in accordance with the present invention comprises the following elements:

(a) an attachment part, made of insulating resin, attached to the radio machine;

(b) an antenna element, made of conductor, placed over the attachment part;

(c) a connection terminal formed at the attachment part for electrically connecting the antenna element to a circuit part of the radio machine;

(d) a snap part projecting from the attachment part; and (e) a top cover, made of insulating resin, for covering the antenna element.

The snap part is constituted by a claw-shaped metal or a resin embedded with metal. The connection terminal for electrically connecting the antenna element to the circuit part of the radio machine is formed at the attachment part.

In this structure, connection terminal electrically connected to the antenna element directly connects to a prescribed circuit of the radio machine. Therefore, the antenna element and the prescribed circuit of the radio machine are electrically interconnected through the connection terminal. As a result, the attachment part can be made of insulating resin, and therefore, mass of the antenna device in the structure can be reduced. In addition, the structure can reduce connecting part where the electrical loss of the high frequency current is apt to occur, and thus, the structure hardly affect receiving sensitivity of the radio machine. Since a snap part having a metal part as a mounting means to the radio machine is formed at the attachment part, easy and strong mounting to the radio machine is allowed.

Since the snap part includes the metal part, it hardly bends or folds and can be strong.

When the metal part of the snap part and the connection terminal are integrally formed of one member in the antenna device of the present invention, number of components can be reduced, and positions of the metal part of the snap part and the connection terminal can be easily arranged in high accuracy. Therefore, the antenna device having good mountability to the radio machine and stable electric connectability can be easily provided.

DETAILED DESCRIPTION OF THE PREFERRED EMBODIMENTS

Embodiments of the present invention are described hereinafter with reference to FIG. 1 to FIG. 21. The same elements used in the prior art are denoted with the same reference numbers, and their detail descriptions are thus omitted.

(Preferred Embodiment 1)

Figure 1A:
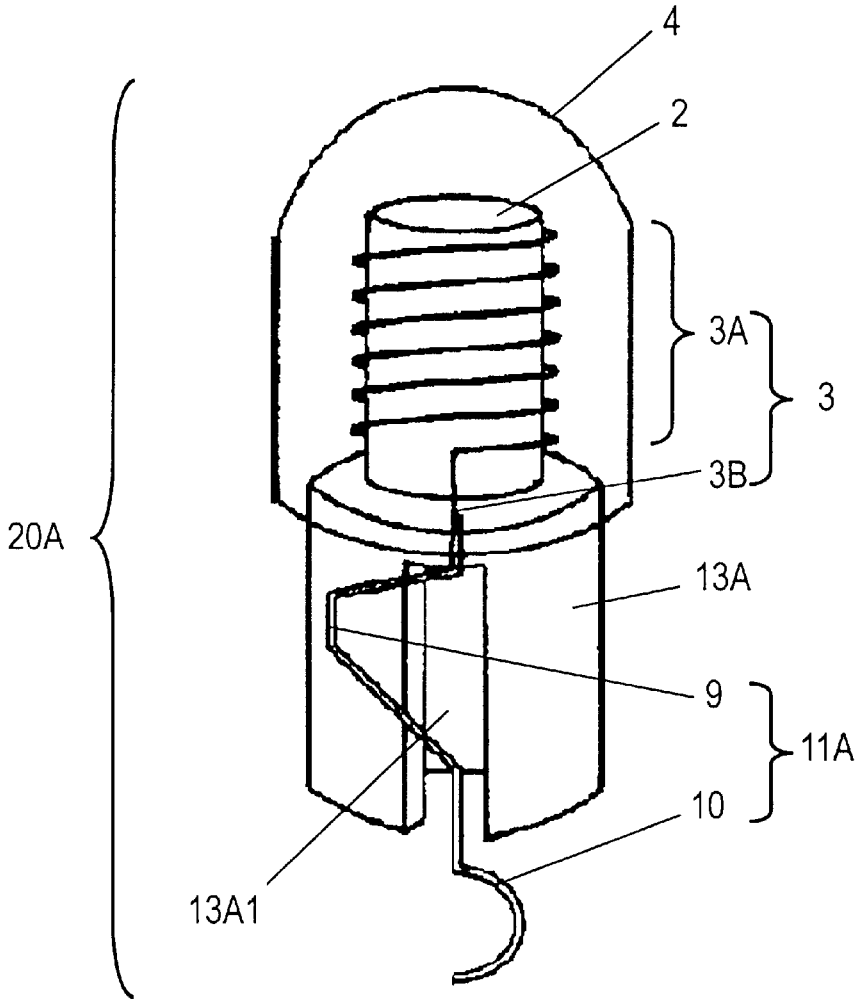
FIG. 1A is a perspective view of an antenna device in accordance with exemplary embodiment 1 of the present invention.
Figure 1B:
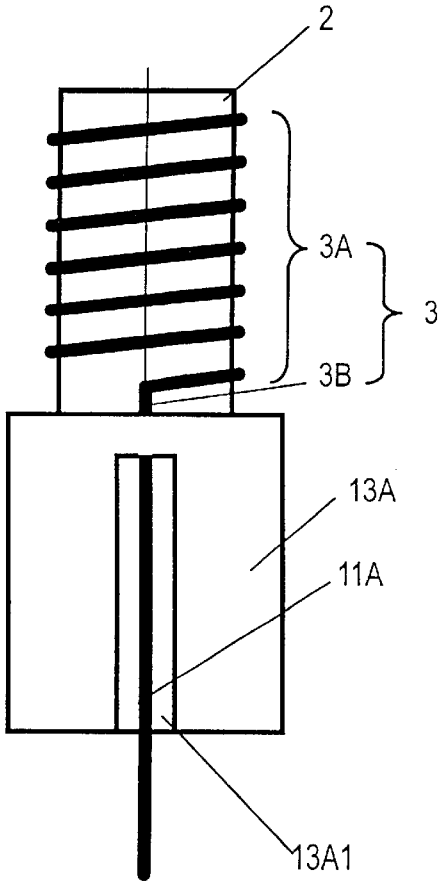
FIG. 1B is a front view of the antenna device shown in FIG. 1A.
Figure 1C:
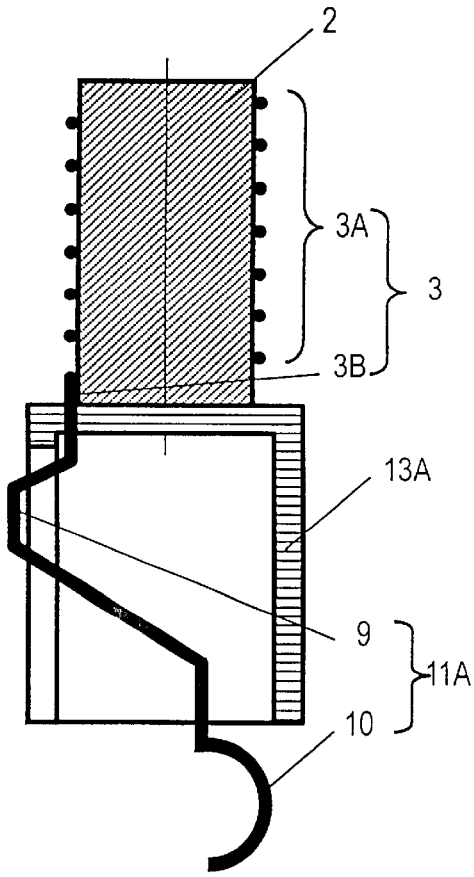
FIG. 1C is a side sectional view of the antenna device shown in FIG. 1A.

FIG. 1A is a perspective view of an antenna device in accordance with embodiment 1 of the present invention, FIG. 1B is a front view of the antenna device shown in FIG. 1A, and FIG. 1C is a side sectional view of the antenna device shown in FIG. 1A.

As shown in FIG. 1A, FIG. 1B, and FIG. 1C, the antenna device in accordance with embodiment 1 comprises:

(a) core part 2 made of insulating resin;

(b) winding part 3A of a conductive antenna element 3 which is spirally wound on the outer periphery of core part 2;

(c) winding's lower part 3B connected to winding part 3A; and (d) snap terminal 11A that is connected to winding's lower part 3B and integrally constituted by snap part 9 formed in a claw shape and connection terminal 10 in series.

Core part 2 is made of insulating resin such as ABS, nylon, polybutylene-terephthalate (PBT). As winding part 3A of antenna element 3, copper wire or copper alloy wire is used.

Snap terminal 11A is constituted by a metal wire or a metal plate of phosphor bronze or beryllium copper, and its surface is plated with gold or nickel.

Winding's lower part 3B is mechanically and electrically connected to snap terminal 11A in a crimp, burring, welding, or soldering method.

Hollow attachment part 13A having opening 13A1 is fixed under core part 2. Attachment part 13A is made of insulating resin such as ABS, nylon, or PBT. Opening 13A1 is drilled in a sidewall of attachment part 13A. Snap terminal 11A is fixed to attachment part 13A so that snap part 9 projects from opening 13A1 outward of attachment part 13A.

Top cover 4 is formed of insulating resin so as to cover the upper end of attachment part 13A, core part 2, and antenna element 3.

Antenna device 20A is constituted as discussed above.

Figure 2A:
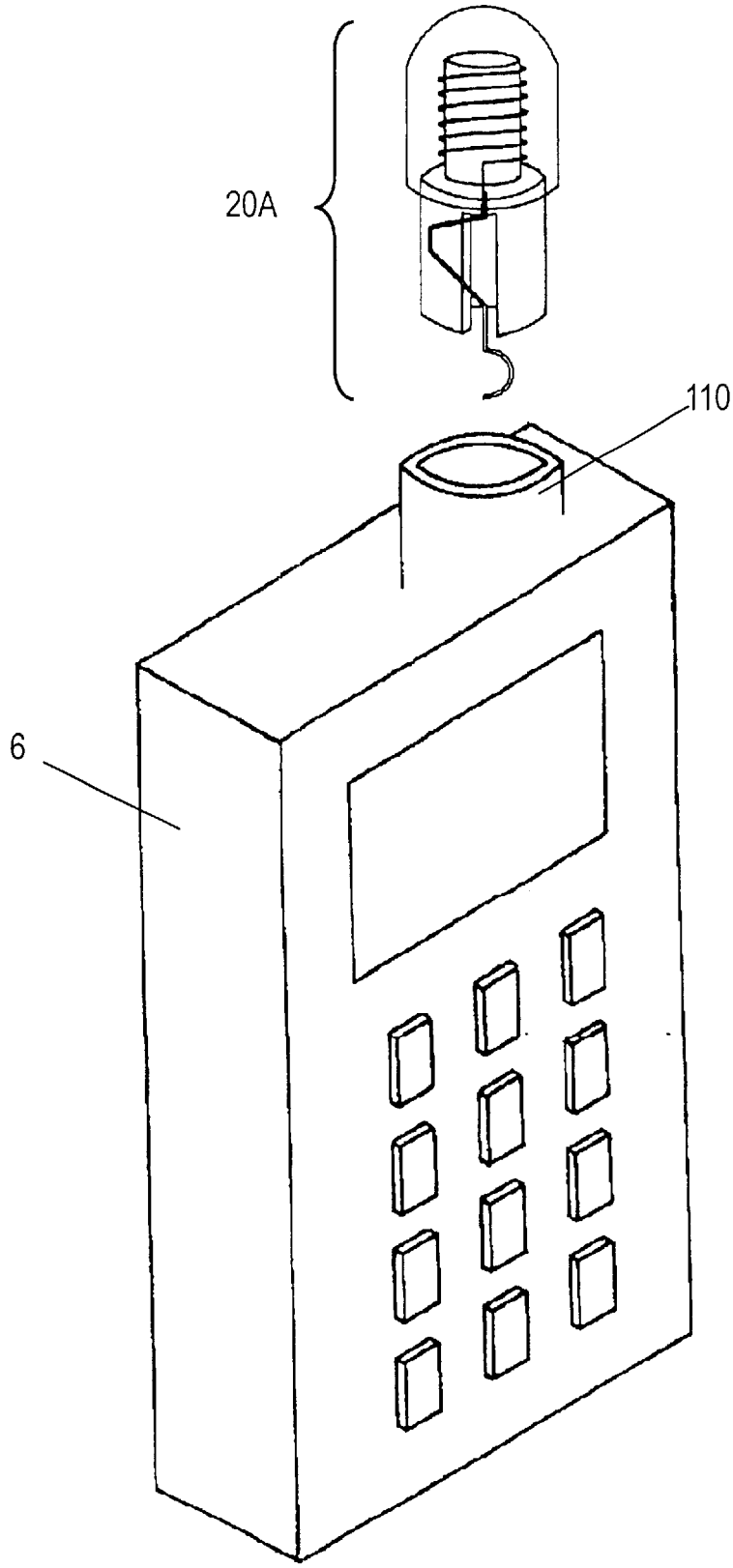
FIG. 2A is a perspective view showing the antenna device of the present invention and a mounting part for mounting the antenna device to the radio machine.
Figure 2B:
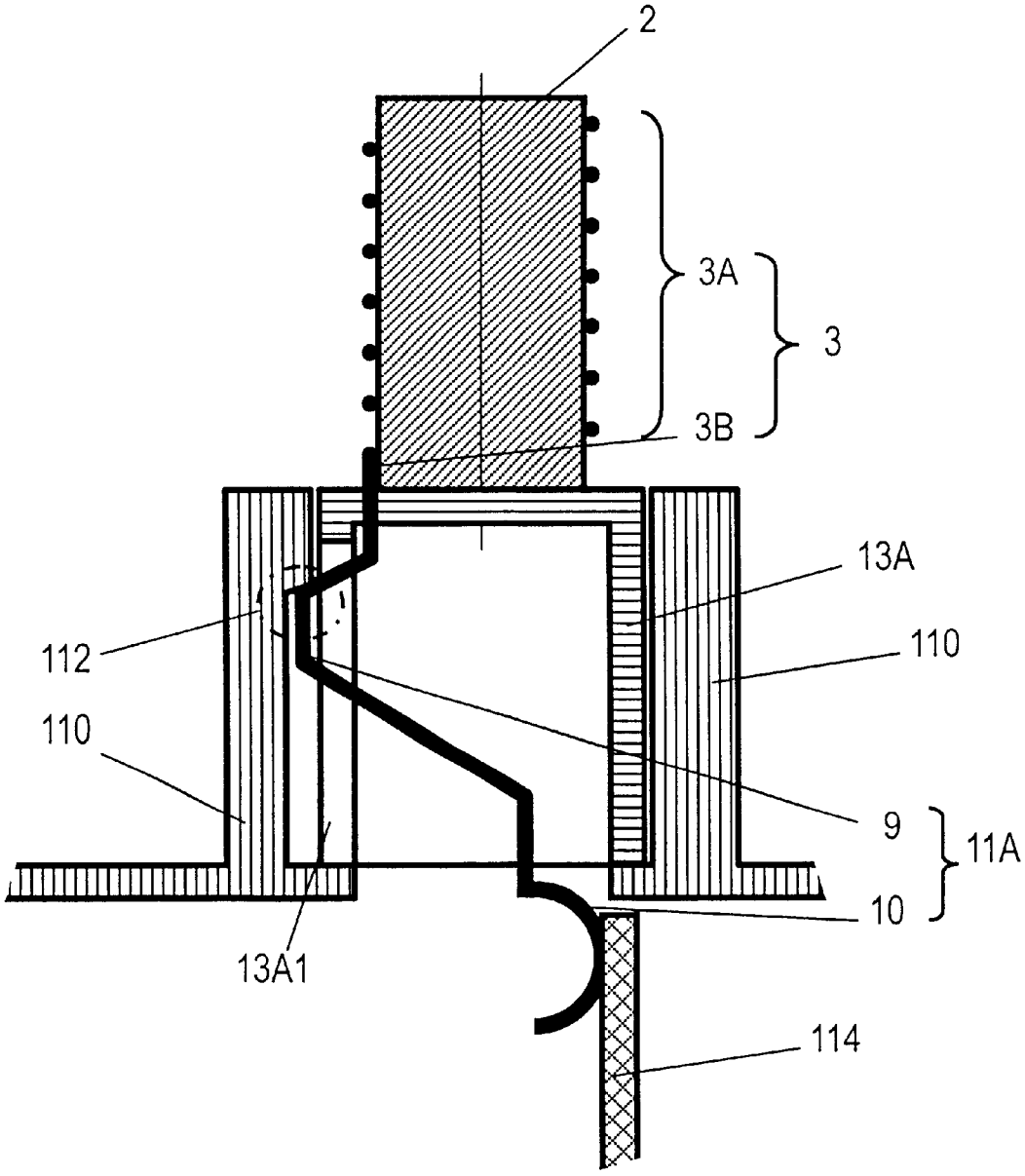
FIG. 2B is a schematic perspective view showing a state where the antenna device in FIG. 2A is attached to the radio machine.

A mounting example of antenna device of the present invention to a radio machine is described hereinafter with reference to FIG. 2A and FIG. 2B. FIG. 2A is a perspective view showing the antenna device of the present invention and a mounting part for mounting the antenna device to the radio machine. FIG. 2B is a schematic perspective view showing a partial state where antenna device 20A of the present invention is attached to the radio machine. As shown in FIG. 2B, antenna device 20A is engaged by inserting a sidewall part of attachment part 13A into tubular part 110 of the radio machine. Thanks to the insertion, snap part 9 of snap terminal 11A is hung on and fixed to engagement step part 112 formed in tubular part 110 of the radio machine. In addition, in the insertion of antenna device 20A, connection terminal 10 of snap terminal 11A projecting out of attachment part 13A directly abuts on a prescribed circuit part on wiring board 114 placed in the radio machine.

Snap part 9 and connection terminal 10 of snap terminal 11A are constituted by one member. Thus, snap terminal 11A can be inexpensively constituted by small number of components. Mounting accuracy of the radio machine, snap part 9, and connection terminal 10 can be increased. Therefore, the antenna device of the present invention can have high mountability to the radio machine and high electric connectivity.

In a state where antenna device 20A is mounted to the radio machine, snap part 9 is slightly pressed toward the inside of attachment part 13A. When the circuit part of the radio machine is placed on the opposite side of an engaging part of snap part 9, connection terminal 10 under snap part 9 strongly abuts to a prescribed circuit part of wiring board 114.

Antenna device 20A of the present invention is mounted to the radio machine via attachment part 13A and snap part 9 of snap terminal 11A (mechanical mounting). Antenna device 20A of the present invention is electrically connected to the radio machine through connection terminal 10 of snap terminal 11A. Therefore, attachment part 13A can be made of insulating resin, and its mass can be reduced.

In the structure discussed above, metallic female screws required on the radio machine side in the prior art can be eliminated. Therefore, mass of the entire radio machine can be reduced.

Since the radio machine has a structure where snap part 9 prevents the radio machine from being come off, a number of mounting processes of the antenna device to the radio machine can be reduced.

As a result, the radio machine can be manufactured at a low cost.

In regard to the radio machine having such structure, high frequency current induced in antenna element 3 flows to the prescribed circuit placed in the radio machine only through snap terminal 11A. Therefore, connecting part can be reduced, and thus electrical loss is reduced. In the structure discussed above, the highly sensitive radio machine is obtainable.

In FIG. 1A and FIG. 1C, connection terminal 10 is placed under attachment part 13A. However, it may project out of the sidewall of the attachment part 13A.

Opening 13A1 in the sidewall of attachment part 13A discussed above has a U shape. Therefore the lower part of snap terminal 11A can freely move through opening 13A1.

Figure 3:
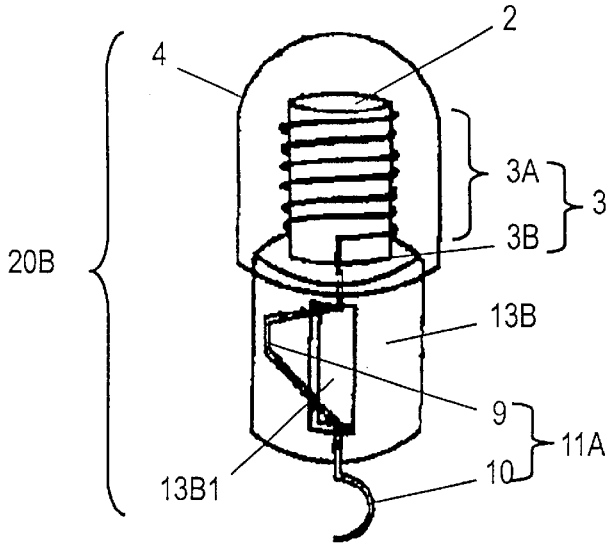
FIG. 3 is a perspective view of an antenna device in accordance with the antenna device in FIG. 1A, where a snap terminal is reinforced.

The opening (through hole 13B1) of attachment part 13B shown in FIG. 3 is rectangular. Only snap part 9 of snap terminal 11A is projected out of through hole 13B1. Part other than snap part 9 may be fixed to attachment part 13B. In this structure, snap part 9 and connection terminal 10 can be placed in high positional accuracy. As a result, antenna device 20B and the radio machine can have stable electric connectivity.

Figure 4A:
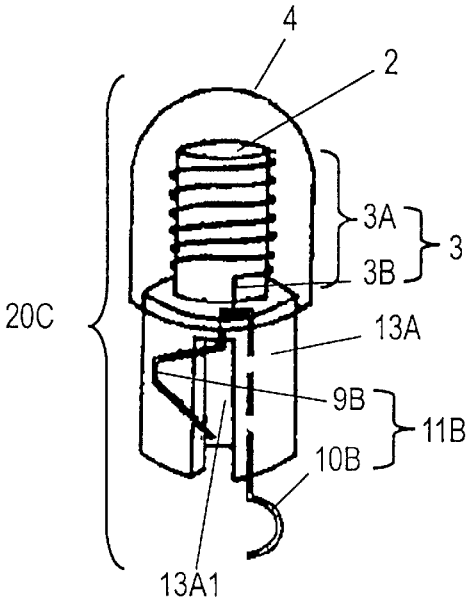
FIG. 4A is a perspective view of the antenna device in accordance with the antenna device in FIG. 1A, where a snap terminal has the other structure.
Figure 4B:
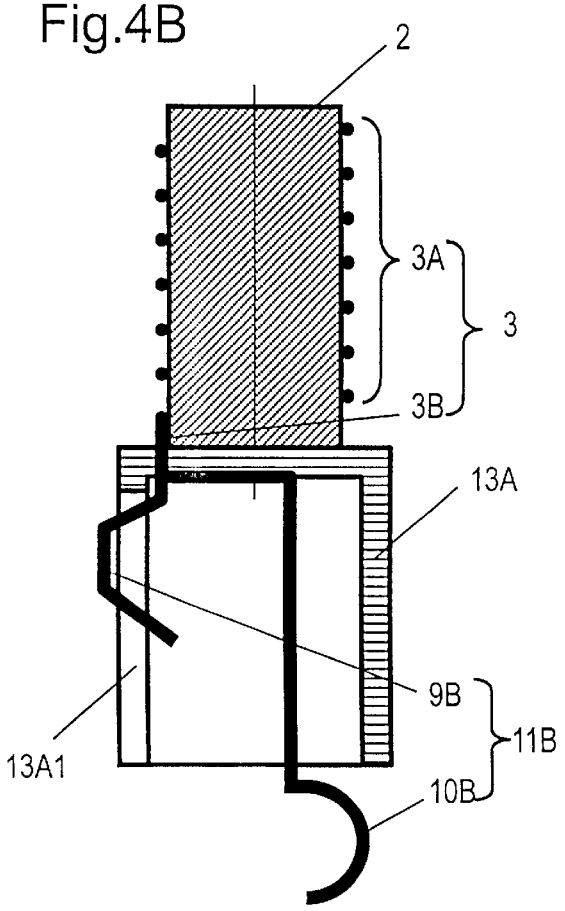
FIG. 4B is a side sectional view of the antenna device shown in FIG. 4A.

Antenna device 20C shown in FIG. 4A and FIG. 4B has snap terminal 11B where snap part 9B and connection terminal 10B are formed in parallel. FIG. 4B is a side sectional view of the antenna device shown in FIG. 4A.

Snap part 9B and connection terminal 10B are constituted by one member. Snap terminal 11B formed as discussed above is connected to winding's lower part 3B. Snap part 9B is constituted so as to project out of opening 13A1 in the sidewall of attachment part 13A. In this case, snap part 9B and connection terminal 10B are movable mutually independently. Thus, respective elastic forces of snap part 9B and connection terminal 10B can be adequately set as required.

In the antenna device shown in FIG. 1A, FIG. 3, and FIG. 4A, snap terminal (11A or 11B) is connected to antenna element 3. In the snap terminal, the snap part and the connection terminal are constituted by one member. However, the snap part and the connection terminal may be constituted by independent members, and only connection terminal may be connected to the antenna element. In addition, only connection terminal may be integrated with the antenna element.

Figure 5:
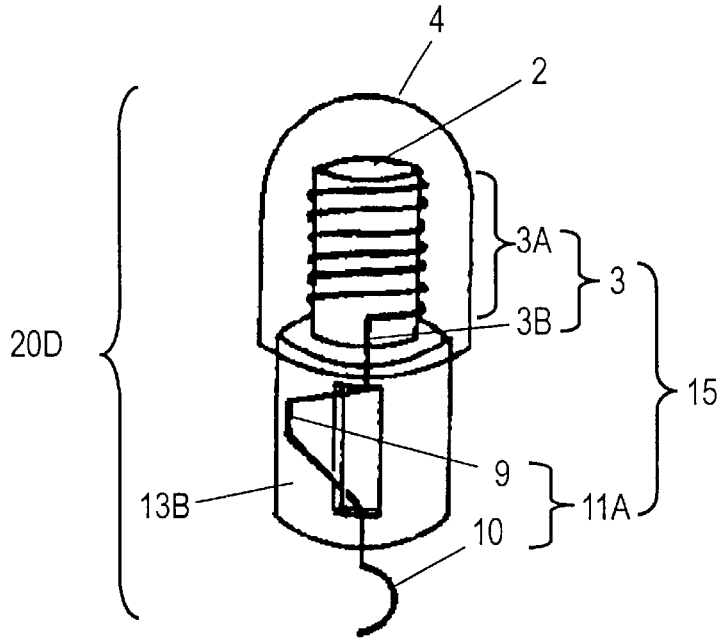
FIG. 5 is a perspective view of an antenna device in accordance with the antenna device in FIG. 1A, where an antenna element and a snap terminal are constituted by one member.

FIG. 5 is a perspective view of antenna device 20D. Antenna device 20D employs antenna element snap terminal 15 where antenna element 3 and snap terminal 11A are constituted by the same member. Electric connecting part of antenna device 20D having this structure can be further reduced comparing with the antenna device shown in FIG. 1A, FIG. 3, and FIG. 4A. Therefore, antenna device 20D can minimize electrical loss of high frequency current induced in antenna element 3, and realize a better electric characteristic. The antenna device having the antenna element integrated with only connection terminal can provide an equivalent effect.

In the antenna device having the structure shown in FIG. 5, antenna element snap terminal 15 is formed by punching a metal plate with 0.1–0.4 mm thickness, and then by machining antenna element 3, snap part 9, and connection terminal 10 in given shapes.

In the antenna device formed in this method, widths and shapes of antenna element 3, snap part 9, and connection terminal 10 can be arbitrarily set. As the metal plate, a copper plate and copper alloy plate are adequately used.

Figure 6A:
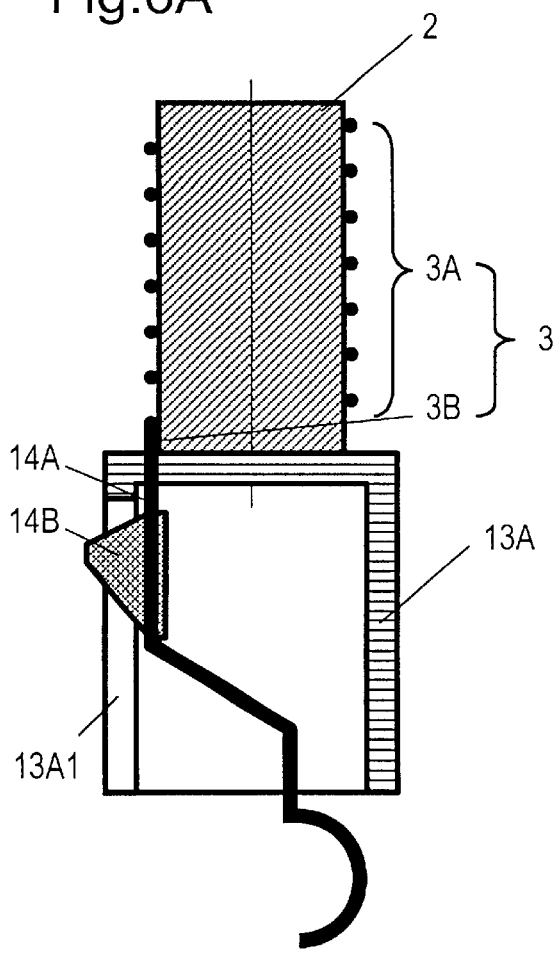
FIG. 6A is a side sectional view of the antenna device where the snap part shown in FIG. 1A is constituted by a metallic reinforcing part 14A and a resin made claw 14B.
Figure 6B:
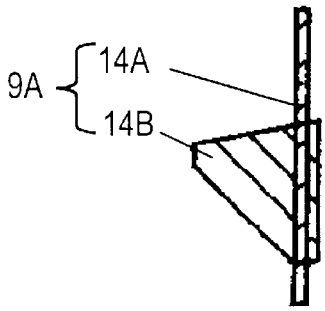
FIG. 6B is an enlarged fragmentary view of the snap part shown in FIG. 6A.
Figure 7A:
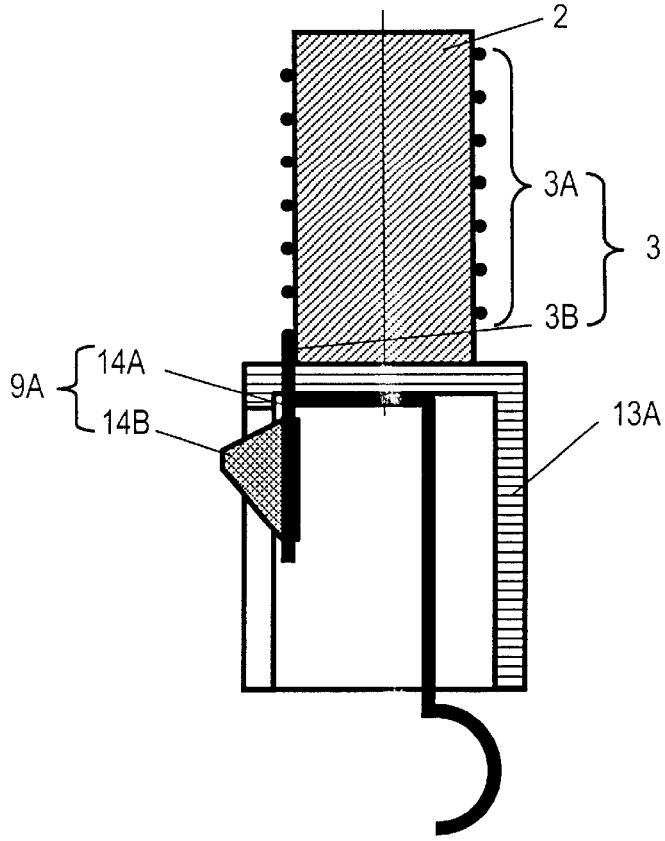
FIG. 7A is a side sectional view of the antenna device where the snap part shown in FIG. 4A is constituted by a metallic reinforcing part 14A and a resin made claw 14B.
Figure 7B:
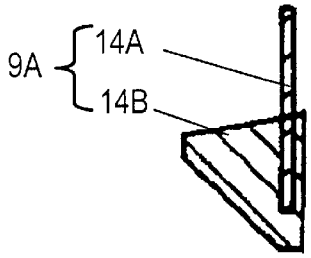
FIGS. 7B, C, D, E are enlarged fragmentary views of various structures of the snap part shown in FIG. 7A.
Figure 7D:
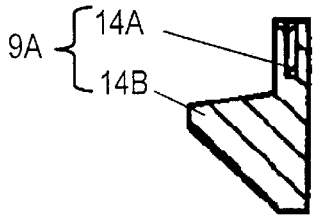
Figure 7C:
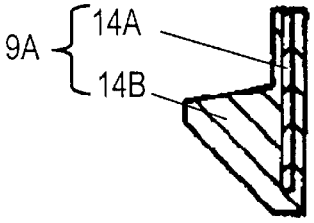
Figure 7E:
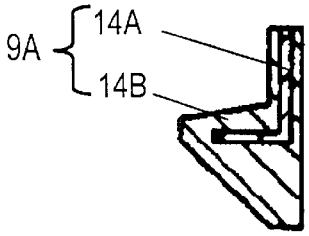

In the antenna devices shown in FIG. 1A, FIG. 3, FIG. 4A, and FIG. 5, a claw of snap part (9 or 9B) of snap terminal (11A or 11B) is made of metal. As shown in FIG. 6A and FIG. 7A, however, snap part 9A may be constituted by a reinforcing part 14A made of metal and claw 14B made of resin. FIG. 6B, FIG. 7B, FIG. 7C, FIG. 7D, and FIG. 7E show structure examples of reinforcing part 14A and resin made claw 14B. In these structures, reinforcing part 14A prevents snap part 9A from folding, and claw 14B can be easily formed in a desired shape.

Figure 8A:
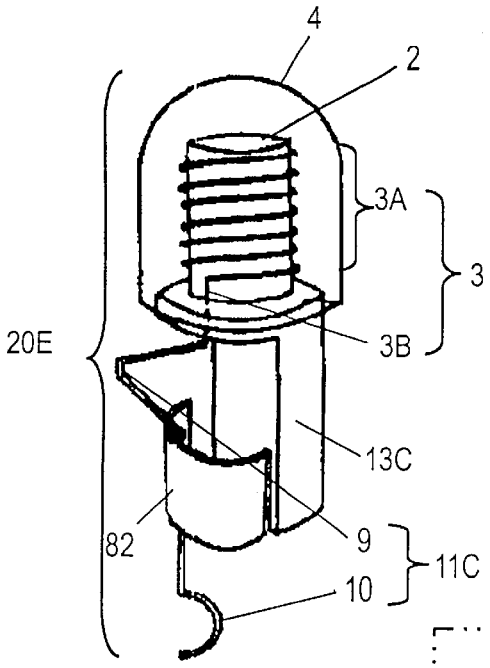
FIG. 8A is a perspective view of an antenna device in accordance with the antenna device in FIG. 1A, where a part of the snap terminal is machined in a shape corresponding to a mounting part on the radio machine side.
Figure 8B:
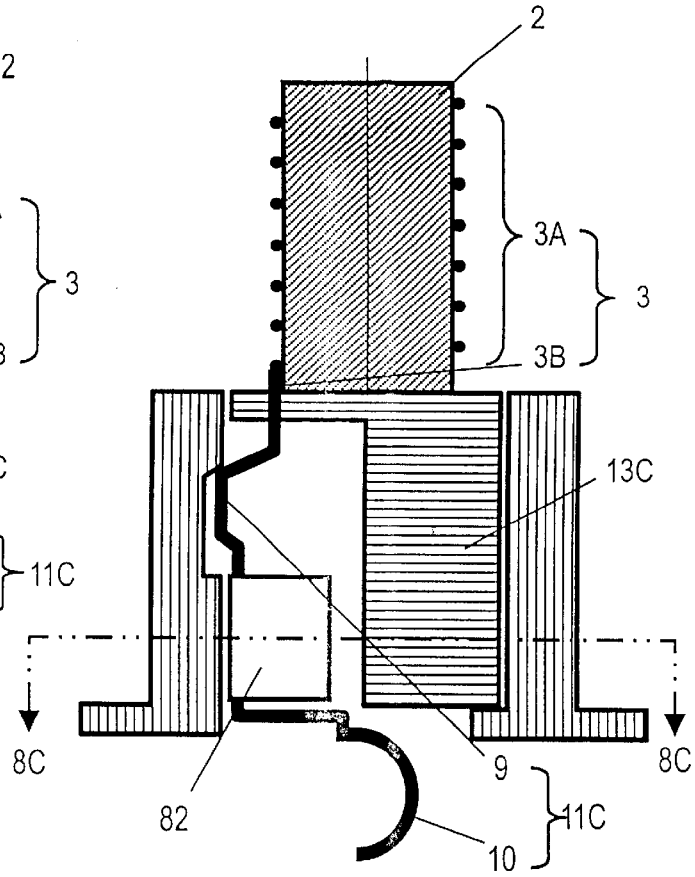
FIG. 8B is a side sectional view of the antenna device shown in FIG. 8A.
Figure 8C:
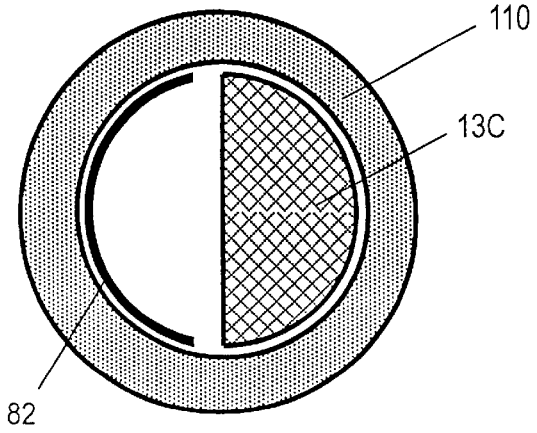
FIG. 8C shows a cross section along a 8C—8C line in the antenna device shown in FIG. 8B.

FIG. 8A is a perspective view of an antenna device having a snap terminal part with the other structure. FIG. 8B is a side sectional view of the antenna device shown in FIG. 8A. FIG. 80 shows a cross section along a 8C—8C line in the antenna device shown in FIG. 8B. As shown in FIG. 8A, FIG. 8B, and FIG. 8C, a part of snap terminal 11C is antenna device 20E machined in a circular arc shape responsive to (matching to) a side surface of a mounting part on the radio machine side. Because in this structure a circular-arc-shaped part 82 of snap terminal 11C can be pressed and mounted to the sidewall of the mounting part on the radio machine by broad area, mountability to the radio machine is improved.

This circular-arc-shaped part is preferably made of metal or resin.

FIG. 8A, FIG. 8B, and FIG. 8C show an antenna device where a part of snap terminal 11C is formed in the circular arc shape. The snap terminal 11C must be shaped responsively to the mounting part on the radio machine side.

In any antenna device described above, top cover 4, core part 2, and attachment part (13A, 13B, or 13C) are constituted by independent members. They are made of resins.

When the core part for holding an antenna element is formed and simultaneously the attachment part is integrally formed,

- the attachment part is integrally formed and simultaneously the top cover is integrally formed, or
- the core part for holding the antenna element is formed and simultaneously the top cover is integrally formed,
- at least one of processes for forming the antenna device using resin can be eliminated. Therefore, manufacturing processes of the antenna device can be simplified, number of components can be reduced, and an inexpensive antenna device can be supplied.

In addition, it is possible that after antenna element 3 is placed without forming core part 2 top cover 4 is directly formed to cover antenna element 3. This structure also provides an effect similar to the structure discussed above.

Number of snap parts and connection terminals may be plural as required. Especially, an antenna device having a plurality of snap parts can be fixed to the radio machine strongly and less tiltingly. Therefore, in this structure, the radio machine having excellent appearance can be easily obtained.

(Preferred Embodiment 2)

Figure 9A:
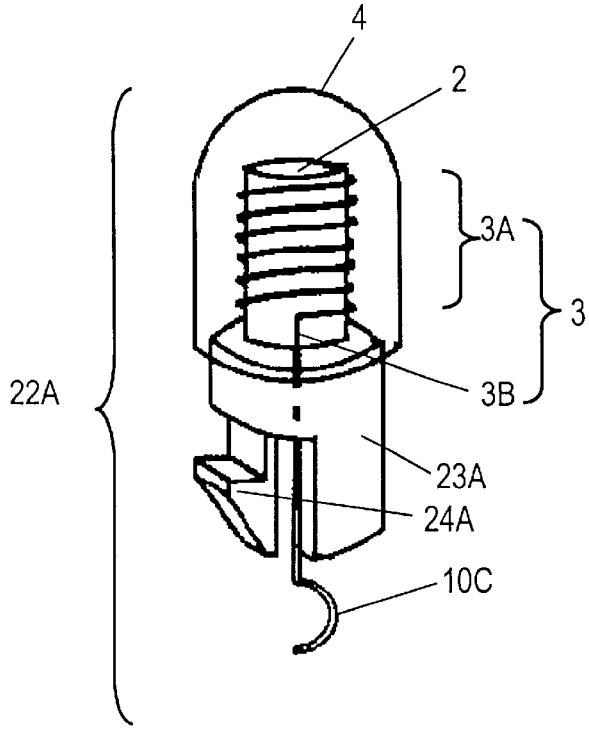
FIG. 9A is a perspective view of an antenna device in accordance with exemplary embodiment 2 of the present invention.
Figure 9B:
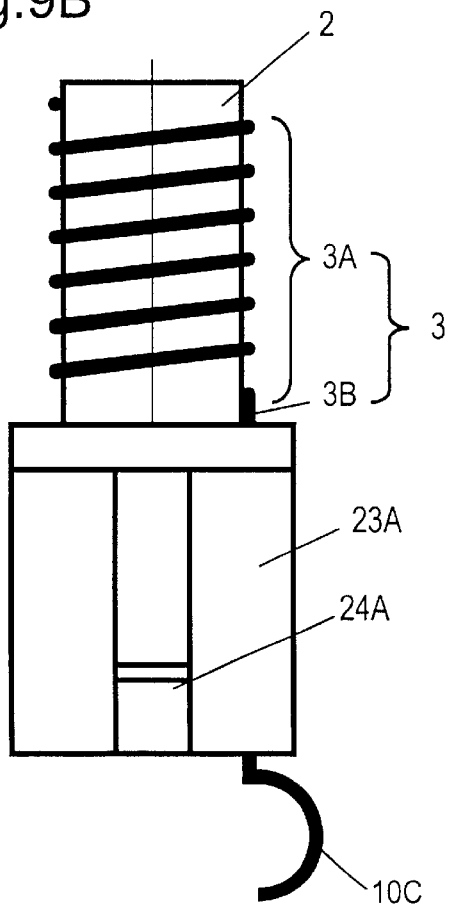
FIG. 9B is a front view of the antenna device shown in FIG. 9A.
Figure 9C:
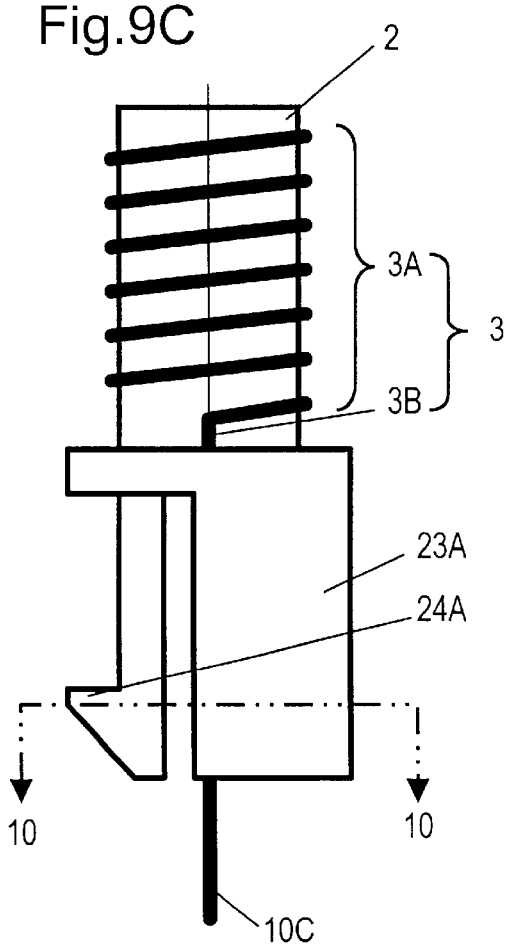
FIG. 9C is a side sectional view of the antenna device shown in FIG. 9A.

FIG. 9A is a perspective view of an antenna device in accordance with embodiment 2 of the present invention. FIG. 9B is a front view of the antenna device shown in FIG. 9A. FIG. 9C is a side sectional view of the antenna device shown in FIG. 9A. As shown in FIG. 9A, FIG. 9B, and FIG. 9C, antenna element 3 of antenna device 22A in accordance with embodiment 2 is the same as antenna element 3 in embodiment 1.

In antenna device 22A in accordance with embodiment 2, however, only connection terminal 10C is electrically connected to winding's lower part 3B. Connection terminal 10C comprises a wire or a plate made of phosphor bronze or beryllium copper. The surface of connection terminal 10C is plated with gold or nickel. As shown in FIG. 9A, attachment part 23A made of insulating resin such as ABS, nylon, or PBT has claw-shaped snap part 24A. Connection terminal 10C is fixed to a prescribed position of attachment part 23A. Top cover 4 made of insulating resin is formed on the outer periphery of antenna element 3 in order to cover core part 2 and antenna element 3. Antenna device 22A of embodiment 2 is constituted as discussed above.

Figure 10:
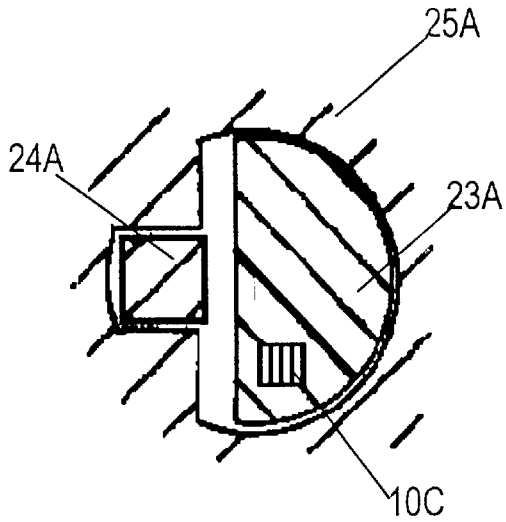
FIG. 10 is a sectional view along a 10—10 line in FIG. 9C showing a mounting state to the radio machine of the antenna device in accordance with the antenna device shown in FIG. 9A.

FIG. 10 is a sectional view along a 10—10 line in FIG. 9C after mounting of the antenna device to the radio machine.

As shown in FIG. 10, attachment part 23A and snap part 24A of antenna device 22A are inserted into tubular part 25A of a radio machine (not shown) having a configuration corresponding to the outer peripheral shapes of attachment part 23A and snap part 24A. After the insertion, snap part 24A is hung on an engagement step part (not shown) formed in a mounting place of the radio machine. As a result, antenna device 22A is fixed to the radio machine. In addition, thanks to the insertion, connection terminal 10C projecting downward of attachment part 23A directly abuts to a prescribed circuit part on a wiring board (not shown) placed in the radio machine. The antenna device of embodiment 2 is mounted to the radio machine as discussed above.

As shown in FIG. 10, snap part 24A is mounted to attachment part 23A. Depending on the shape of attachment part 23A, tubular part 25A, namely a mounting part on the radio machine side, may be formed in a configuration (other than cylinder) having directionality. Even when tubular part 25A has a directional shape, mounting attitude of antenna device 22A can be easily recognized based on the shape of snap part 24A. It is easy to use snap part 24A as a mounting-position determining means. As a result, antenna device 22A shown in FIG. 9 is further adequately mounted to the radio machine.

Figure 11:
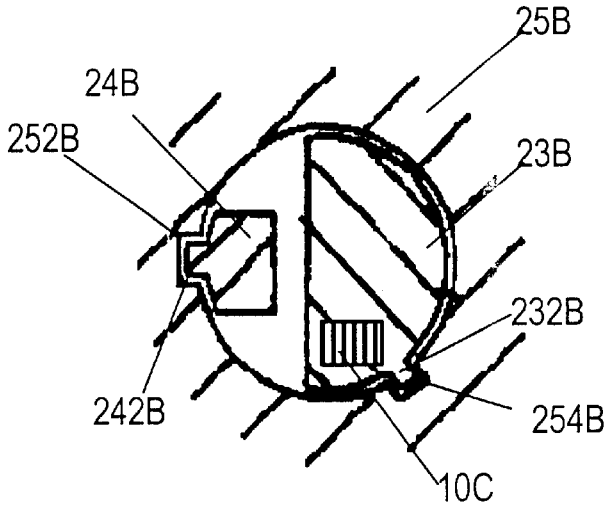
FIG. 11 is a sectional view along a 10—10 line in FIG. 9C showing a mounting state to the radio machine of the other antenna device in accordance with the antenna device shown in FIG. 9A.

FIG. 11 shows the snap part shown in FIG. 10 and an example of the other configuration of the tubular part of the radio machine. As shown in FIG. 11, projection 242B is formed on snap part 24B, and projection 232B is formed on attachment part 23B. Recessed parts 252B, 254B a re formed at positions corresponding to respective projections in tubular part 25B of the radio machine. This structure can include a mounting-position determining function similarly to the antenna device shown in FIG. 10. In the antenna device shown in FIG. 11, especially, snap part 24B and attachment part 23B are integrally formed of insulating resin. Therefore, projections 242B, 232B are easily formed in desired shapes The shapes of the mounting parts on the radio machine side are fitted to the shapes of the projections. Oppositely, the shapes of the attachment parts of the antenna device may be fitted to the shapes of the mounting parts on the radio machine side.

Also when a projection is formed on one of snap part 24B and attachment part 23B, a similar effect can be expected. In addition, projections 242B, 232B are not integrally formed with snap part 24B and attachment part 23B, respectively, and may be fixed to the other members such as pins or projecting pieces.

Furthermore, even when recessed parts are formed in the snap part and the attachment part and projections engaging with the recessed parts are formed on the inner periphery of the mounting part on the radio machine side, a similar effect can be obtained.

As discussed above, antenna device 22A in accordance with the present invention is (mechanically) mounted to the radio machine through attachment part 23A and snap part 24A formed integrally with it. Snap part 24A serves as the mounting-position determining function to the radio machine. Antenna element 3 and the radio machine are electrically interconnected through connection terminal 10C. Therefore, attachment part 23A can be made of insulating resin, and thus mass of antenna device 22A of the present invention can be reduced.

Similarly to the antenna device of embodiment 1, antenna device 22A of embodiment 2 is prevented from loosing thanks to snap part 24A. Therefore, the radio machine does not require a metallic female screw, and can be easily assembled and lightened. Thus, the radio machine can be manufactured at low cost.

In the radio machine structured above, high frequency current induced at antenna element 3 can flow only through connection terminal 10C to the prescribed circuit part placed in the radio machine. Therefore, connecting part between the antenna device and the radio machine is small, and thus electrical loss between the antenna device and the radio machine is reduced. The radio machine structured above can have high sensitivity.

Figure 12A:
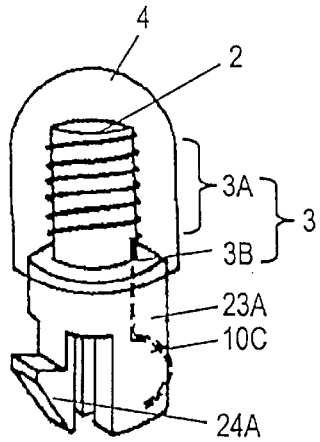
FIGS. 12A, B, C, D are perspective views of an antenna device in accordance with the antenna device shown in FIG. 9A, where a position of a connection terminal, an angle of a snap part, and number of snap parts are varied.
Figure 12D:
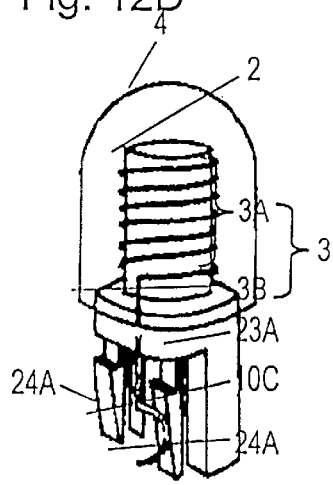
FIG. 12E is a perspective view showing a state where an antenna device having the snap part under the bottom of the attachment part of the antenna device shown in FIG. 9A is mounted to a given member.
Figure 12B:
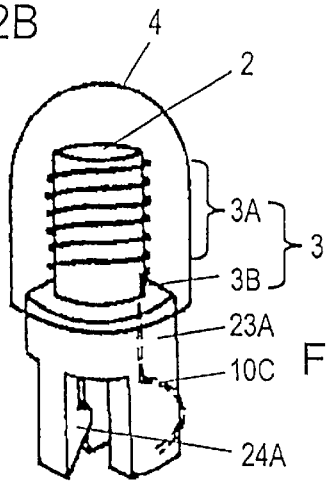

As shown in FIG. 12A and FIG. 12B, a position of connection terminal 10C and a projecting direction of snap part 24A can be set arbitrarily. However, when at least snap part 24A is made to have a mounting-position function to the radio machine, a lower end position of snap part 24A is preferably set at the lower end of attachment part 23A or under the lower end.

Figure 12E:
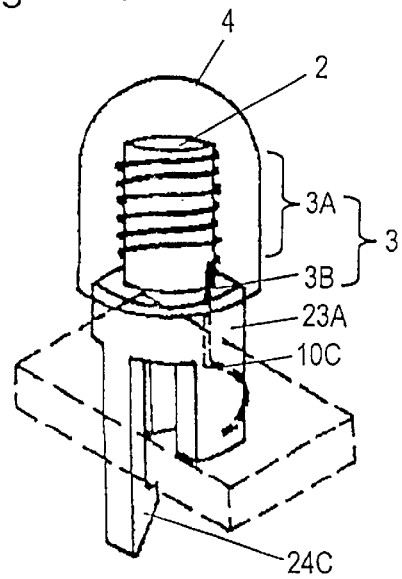
Figure 12C:
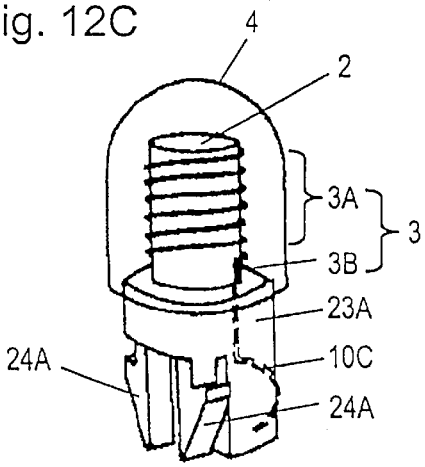

Furthermore, as shown in FIG. 12C and FIG. 12D, a plurality of snap parts 24A may be formed on attachment part 23A. These antenna devices can be mounted to the radio machine more strongly.

FIG. 12E shows a structure where snap part 24C is extended to the downside of the lower end position of attachment part 23A. In an antenna device shown in FIG. 12E, a given member (a part shown by dashed lines in FIG. 12E) such as a case of the radio machine or a wiring board is grabbed between the lower end of attachment part 23A and the upper end of a claw part of snap part 24C. Due to this structure, the antenna device can be strongly mounted to a prescribed place.

Figure 13A:
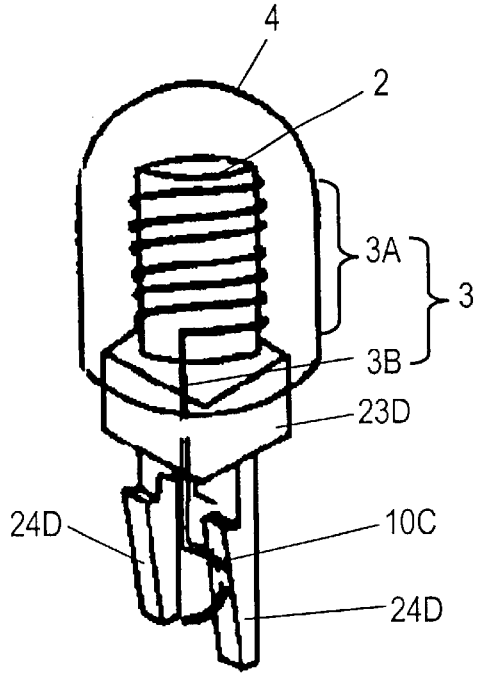
FIG. 13A is a perspective view of an antenna device in accordance with the antenna device shown in FIG. 9A, where only the connection terminal and the snap part are extended on the same plane under the attachment part.
Figure 13B:
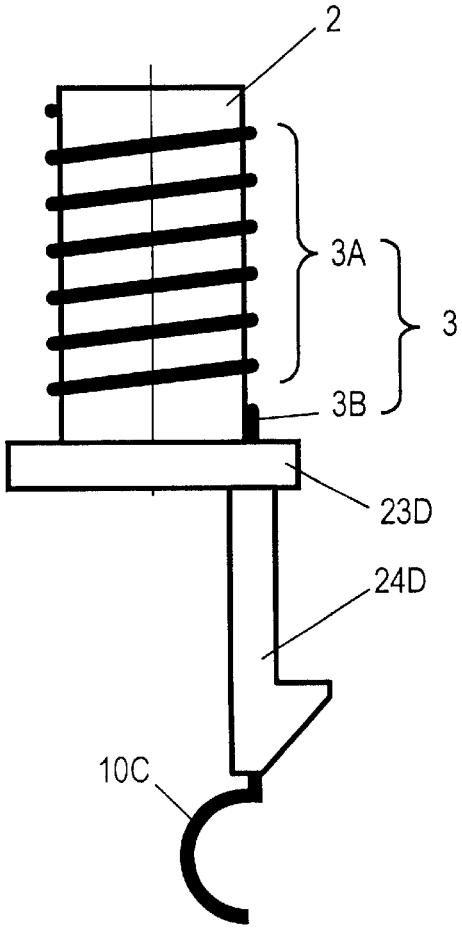
FIG. 13B is a front view of the antenna device shown in FIG. 13A.
Figure 13C:
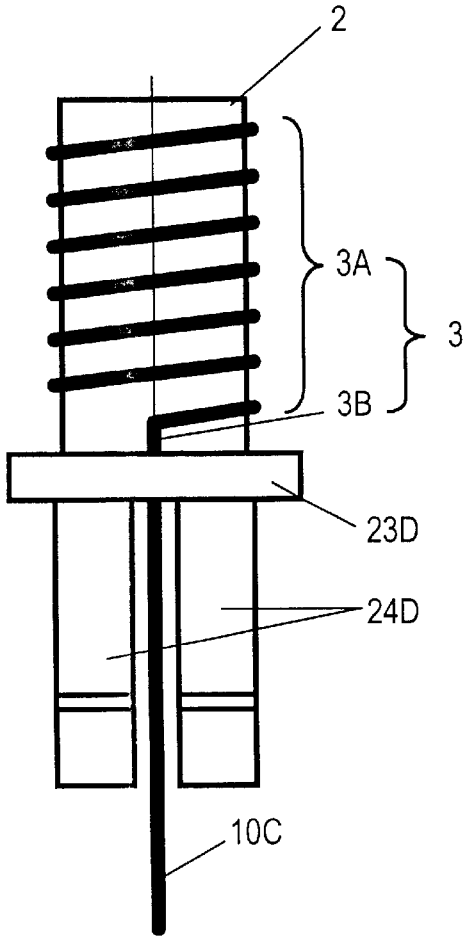
FIG. 13C is a side sectional view of the antenna device shown in FIG. 13A.
Figure 14A:
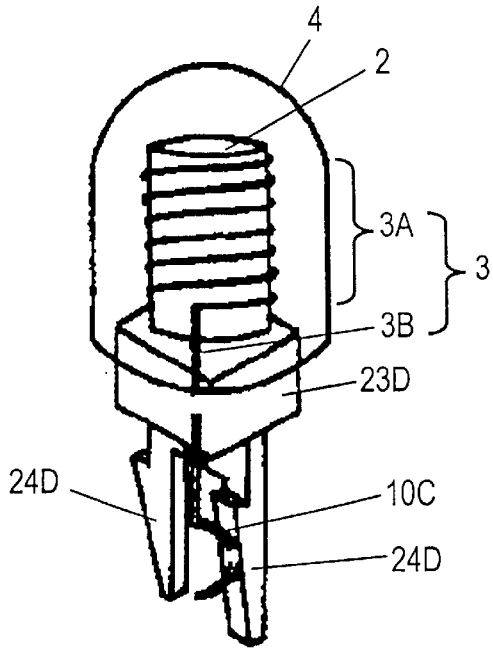
FIG. 14A is a perspective view of an antenna device in accordance with the antenna device shown in FIG. 9A, where only the connection terminal and the snap part are extended on the same plane under the attachment part.
Figure 14B:
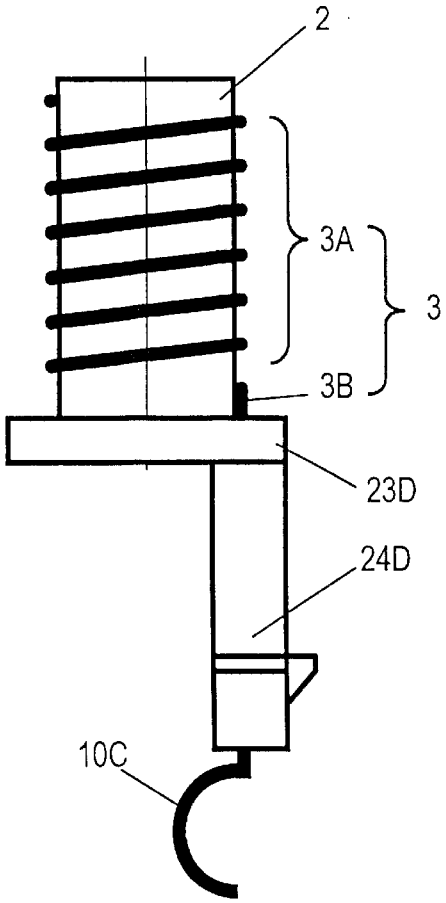
FIG. 14B is a front view of the antenna device shown in FIG. 14A.
Figure 14C:
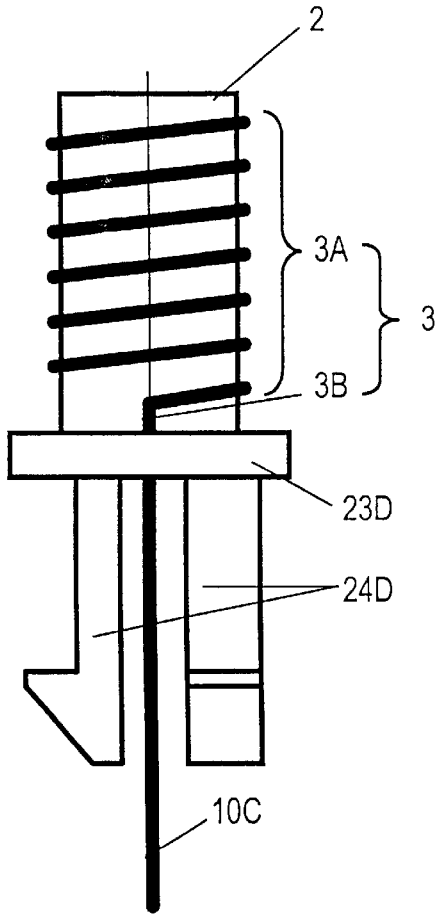
FIG. 14C is a side sectional view of the antenna device shown in FIG. 14A.

FIG. 13A and FIG. 14A show a structure of the attachment part where area required for mounting the antenna device to the radio machine is small. FIG. 13B is a front view of the antenna device shown in FIG. 13A. FIG. 13C is a side sectional view of the antenna device shown in FIG. 13A. FIG. 14B is a front view of the antenna device shown in FIG. 14A. FIG. 14C is a side sectional view of the antenna device shown in FIG. 14A. As shown in FIG. 13A and FIG. 14A, two snap parts 24D and connection terminal 10C are arranged in parallel, on the same plane in side view, and under attachment part 23D. Two snap parts 24D are arranged on the both sides of connection terminal 10C. In regard to the antenna device having such structure, mounting area on the radio machine side can be smaller, and area of the attachment part on the antenna device side can be also reduced. Reduction of the mounting area can increase designing freedom degree on the radio machine side.

As shown in FIG. 13A and FIG. 14A, snap parts 24D are placed on both sides of connection terminal 10C. Therefore, the antenna device can be mounted to the radio machine without tilting in high positional accuracy. As a result, antenna device shown in FIG. 13A and FIG. 14A can have an effect that stability of electrical connection between the radio machine and connection terminal 10C is improved.

Figure 15A:
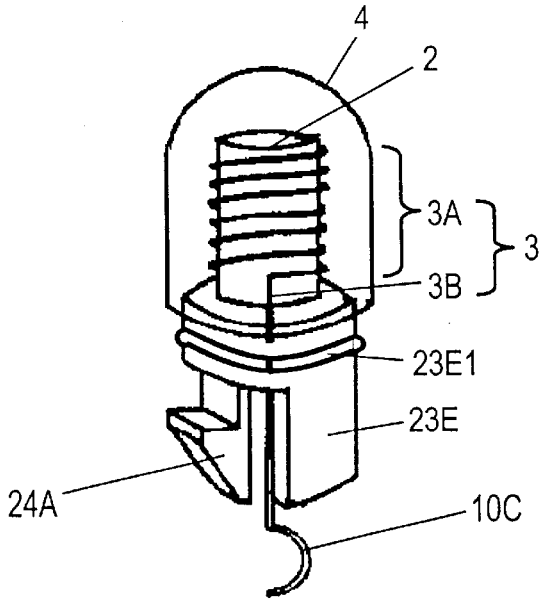
FIG. 15A is a perspective view of an antenna device in accordance with the antenna device shown in FIG. 9A, where a projection for preventing backlash is formed on the attachment part.
Figure 15B:
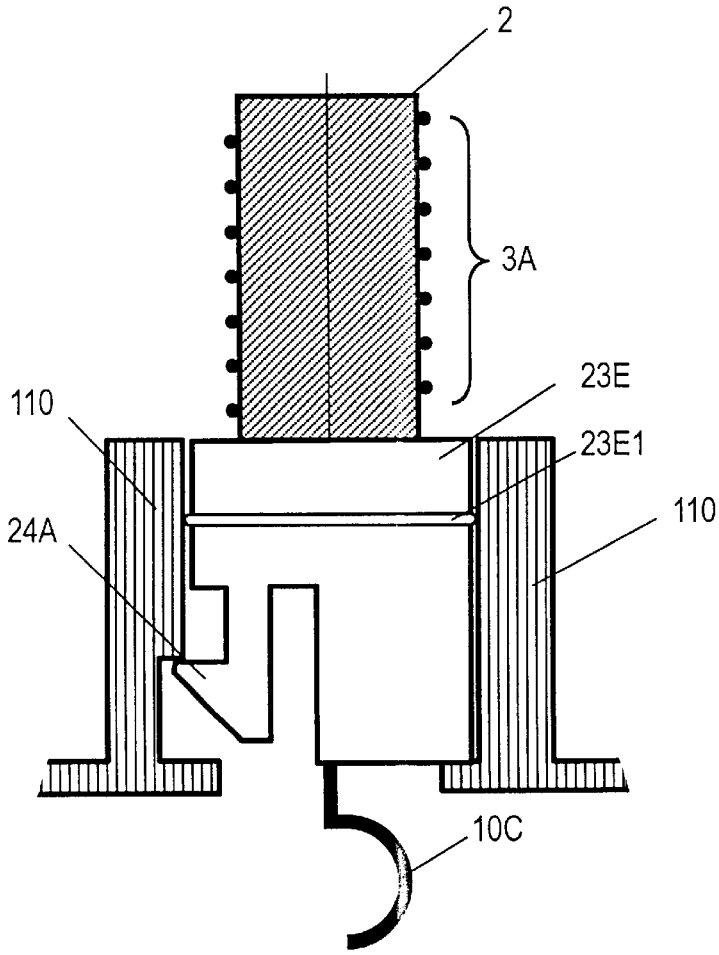
FIG. 15B is a side sectional view of the antenna device shown in FIG. 15A.

FIG. 15A is a perspective view of an antenna device where projection 23E1 for preventing backlash is formed on the side outer periphery of the attachment part 23E. FIG. 15B is a side sectional view of the antenna device shown in FIG. 15A. When projection 23E1 for preventing backlash is formed on the side outer periphery of attachment part 23E as shown in FIG. 1SA and FIG. 15B, adhesiveness between attachment part 23E and a mounting part of the radio machine can be easily improved. The antenna device having this structure can reduce backlash after mounting of the antenna device during holding and operation of the radio machine.

Projection 23E1 may be integrally mounted to attachment part 23E. Otherwise, projection 23E1 may be made of an elastic material such as rubber and separately mounted to attachment part 23E.

Figure 16A:
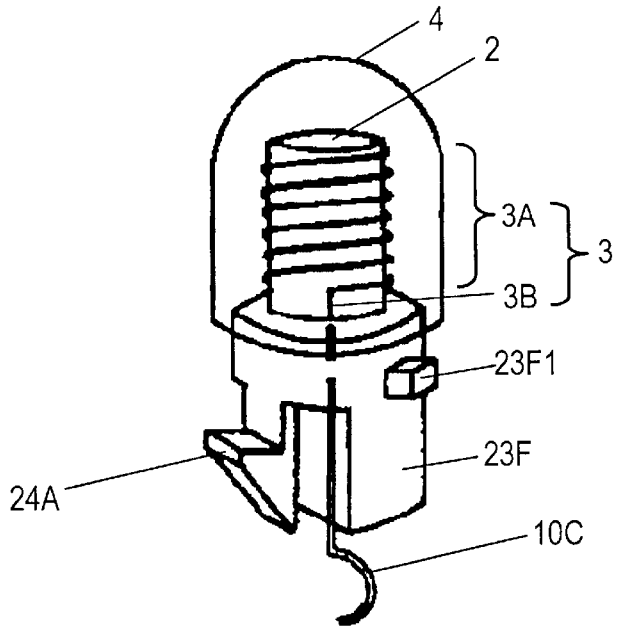
FIG. 16A is a perspective view of an antenna device in accordance with the antenna device shown in FIG. 9A, where a projection for preventing loose is formed on the attachment part.
Figure 16B:
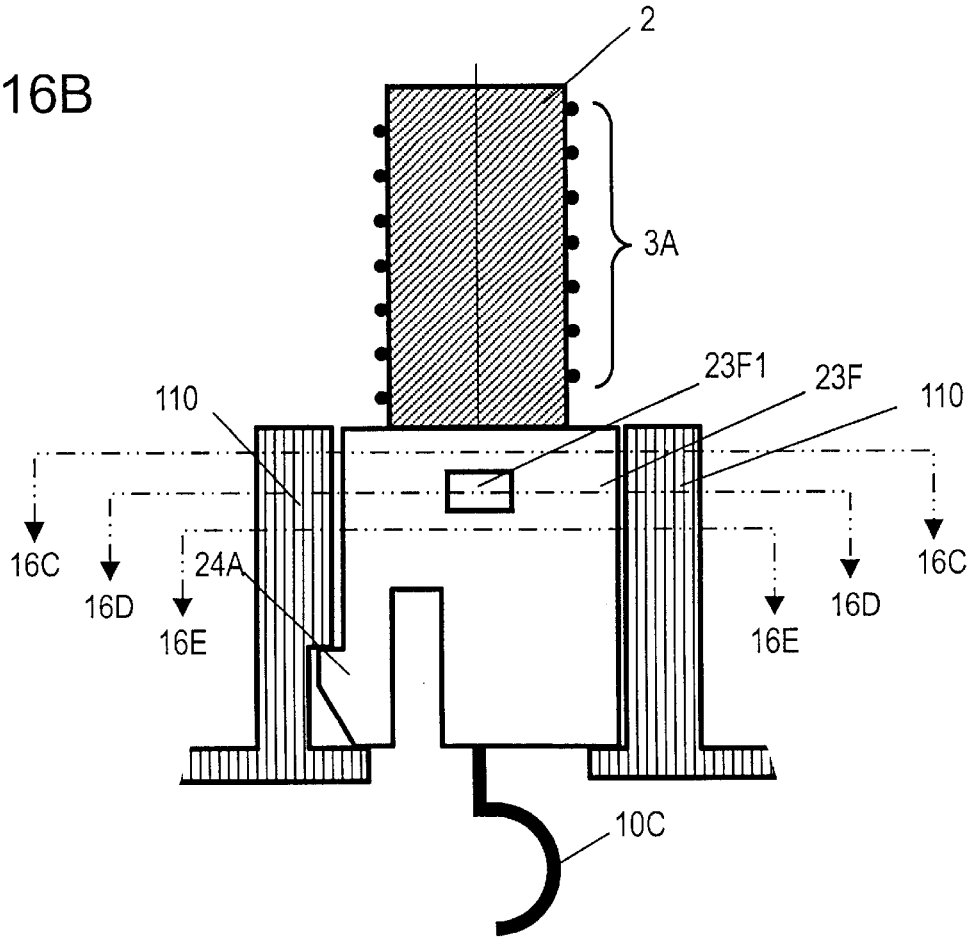
FIG. 16B is a side sectional view of the antenna device shown in FIG. 16A.
Figure 16C:
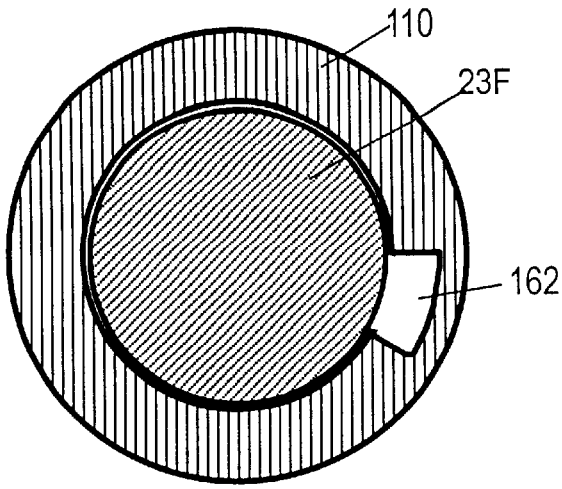
FIG. 16C shows a cross section taken along lines 16C—16C in the antenna device shown in FIG. 16B.
Figure 16D:
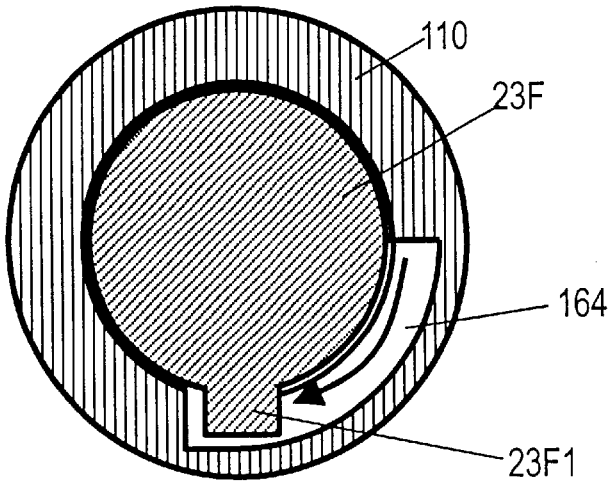
FIG. 16D shows a cross section taken along lines 16D—16D in the antenna device shown in FIG. 16B.
Figure 16E:
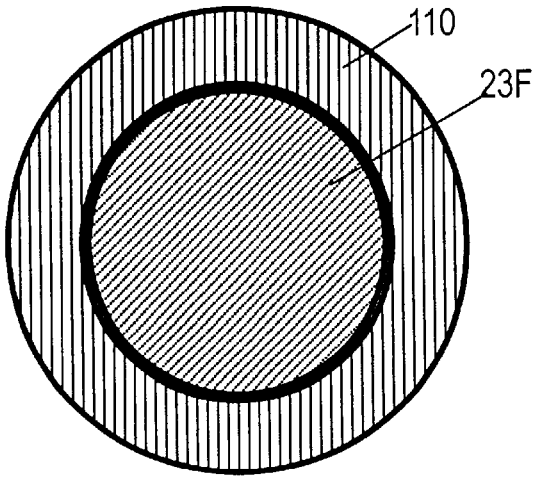
FIG. 16E shows a cross section taken along lines 16E—16E in the antenna device shown in FIG. 16B.

FIG. 16A is a perspective view of an antenna device where projecting part 23F1 for preventing loose is formed at a part of the side surface of the attachment part 23F. FIG. 16B is a side sectional view of the antenna device shown in FIG. 16A. FIG. 16C shows a cross section along a 16C—16C line in the antenna device shown in FIG. 16B. FIG. 16D shows a cross section along a 16D—16D line in the antenna device shown in FIG. 16B. FIG. 16E shows a cross section along a 16E—16E line in the antenna device shown in FIG. 16B.

The antenna device shown in FIG. 16A and FIG. 16B is rotated and mounted to a radio machine. A mounting operation is described hereinafter with reference to FIG. 16C, FIG. 16D, and FIG. 16E. In FIG. 16C, projecting part 23F1 is inserted into a given position in groove 162 formed in the mounting part of the radio machine. The inserted antenna device is rotated along guide groove 164 formed in the mounting part of the radio machine in the direction of the arrow shown in FIG. 16D. Due to this rotation, projecting part 23F1 of the antenna device is hardly-removably fixed to guide groove 164 of the radio machine.

In any antenna device described above, a top cover, a core part, and a attachment part are constituted by independent members. They are made of resins.

When the core part for holding the antenna element is formed and simultaneously the attachment part is integrally formed, the attachment part is integrally formed and simultaneously the top cover is integrally formed, or the core part for holding the antenna element is formed and simultaneously the top cover is integrally formed, at least one of processes for forming the antenna device using resin can be eliminated.

(Preferred Embodiment 3)

Figure 17:
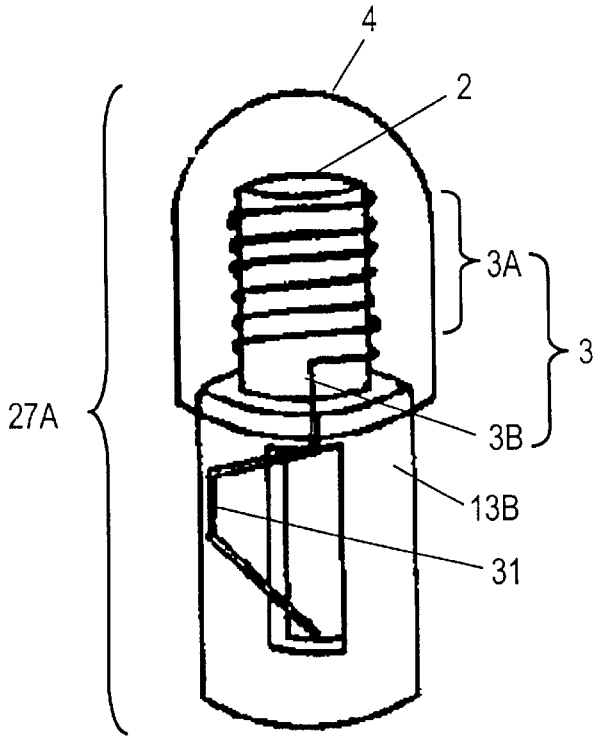
FIG. 17 is a perspective view of an antenna device in accordance with exemplary embodiment 3 of the present invention.

FIG. 17 is a perspective view of an antenna device in accordance with embodiment 3 of the present invention. As shown in FIG. 17, antenna device 27A of embodiment 3 is formed by removing the connection terminal from the antenna device shown in FIG. 3 in accordance with embodiment 1. Antenna element 3 of antenna device 27A of embodiment 3 is same as antenna element 3 of embodiment 1.

Snap terminal 31 formed in a claw shape is disposed under antenna element 3. Snap terminal 31 is electrically connected to antenna element 3. Snap terminal 31 is formed of a wire or a plate of phosphor bronze or beryllium copper, and its surface is plated with gold or nickel. The snap part having such structure is used also as a connection terminal. Because the structure of the snap part is substantially same as that of embodiment 1, detail description is eliminated.

Snap terminal 31 in antenna device 27A of embodiment 3 is a metal part of a snap part having a function of the connection terminal.

Figure 18:
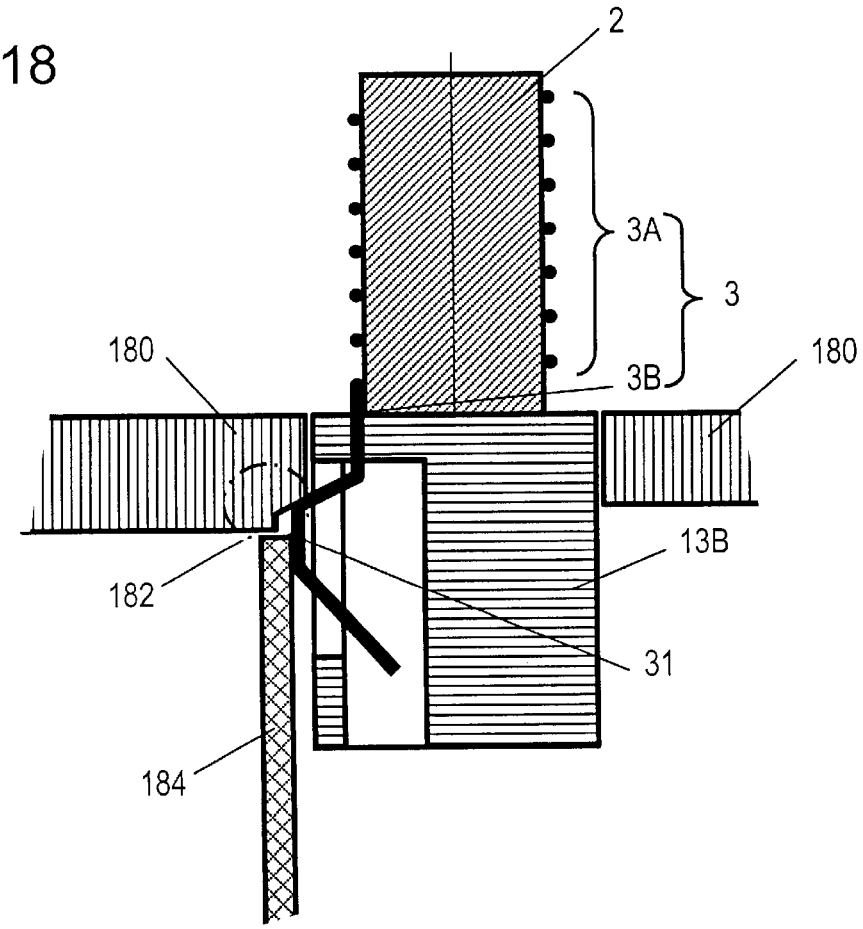
FIG. 18 is a schematic sectional view showing a state where the antenna device shown in FIG. 17 is mounted to the radio machine.
Figure 19A:
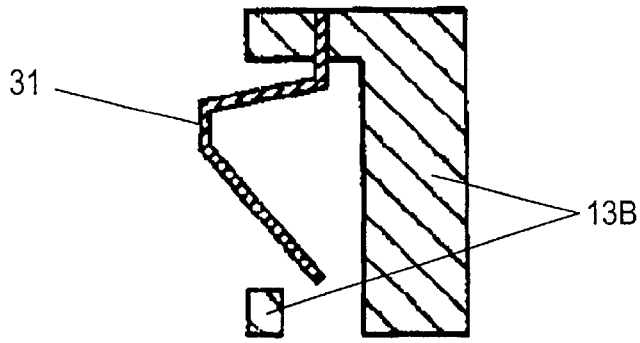
FIGS. 19A, B, C, D are fragmentary sectional views illustrating a fixing states of a snap terminal which is an important part of the antenna device shown in FIG. 17.
Figure 19B:
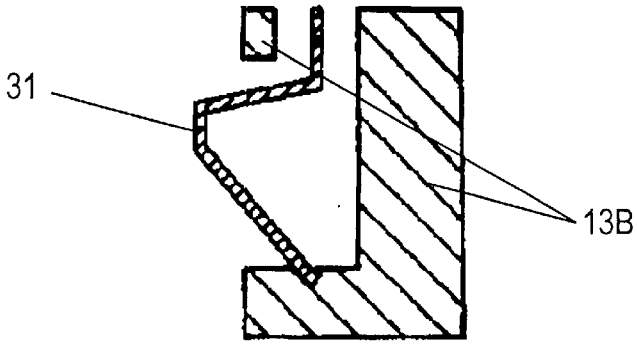
Figure 19C:
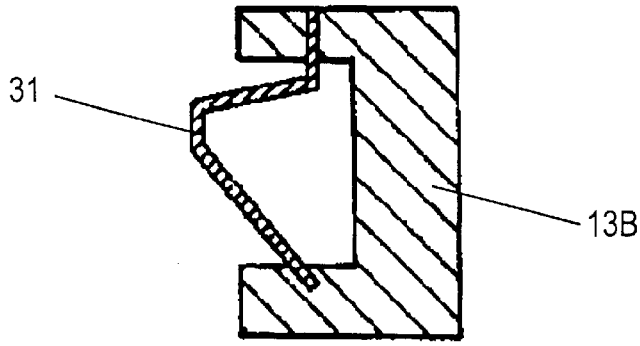
Figure 19D:
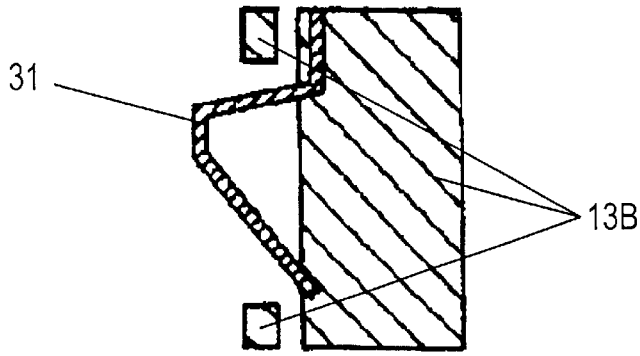

FIG. 18 is a schematic sectional view showing a state where the antenna device 27A in accordance with the present invention is mounted to the radio machine. Snap terminal 31 is hung on and fixed to engaging step part 182 formed in a mounting place of radio machine 180. Snap terminal 31 is directly brought into contact with a prescribed circuit part on wiring board 184 placed in the radio machine, and is mechanically and electrically connected to the radio machine.

The radio machine having such structure allows high frequency current induced by antenna element 3 to flow to the prescribed circuit placed in the radio machine through only snap terminal 31. Therefore, with regard to antenna device 27A of embodiment 3 similarly to that of embodiment 1, connecting part between the antenna device and the radio machine is small, and thus electrical loss between the antenna device and the radio machine is low. In addition, the antenna device can be easily mounted to the radio machine. As a result, the radio machine employing antenna device 27A of embodiment 3 can be easily lightened and can be inexpensive.

Snap terminal 31 of antenna device 27A of embodiment 3 has both functions as a connection terminal and a snap part. Therefore, antenna device 27A can be mechanically and electrically connected to the radio device in high accuracy only by managing accuracy of position and size of snap terminal 31. Since management of snap terminal 31 is only required, managing man-hour can be reduced during manufacturing of antenna device 27A itself.

For increasing positional accuracy of snap terminal 31, snap terminal 31 is reinforced by fixing one or both of upper and lower places of a claw part of snap terminal 31 to attaching part 13B as shown in the sectional views in FIG. 19A, FIG. 19B, FIG. 19C, and FIG. 19D. Thus, folding or bending can be hardly generated. In antenna device 27A of embodiment 3, mounting strength to the radio device can be increased and stability of electric connection can be improved.

Figure 20A:
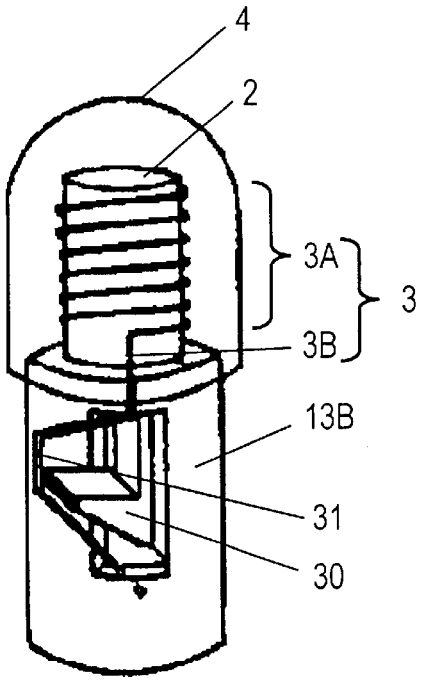
FIG. 20A is a perspective view of an antenna device in accordance with the antenna device shown in FIG. 17, where the snap terminal is reinforced by an elastic claw.
Figure 20B:
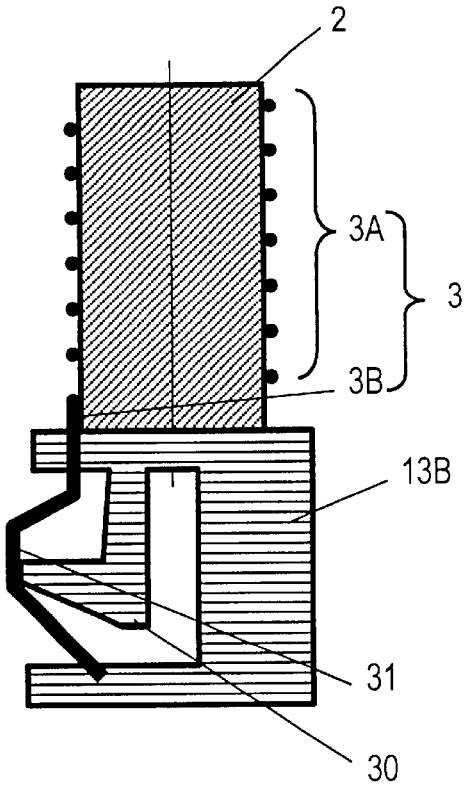
FIG. 20B is a side sectional view of the antenna device shown in FIG. 20A.

FIG. 20A is a perspective view of an antenna device where elastic claw 30 formed on attachment part 13B is brought into contact with the inside of snap terminal 31. FIG. 20B is a side sectional view of the antenna device shown in FIG. 20A. As shown in FIG. 20A and FIG. 20B, the upper and lower parts of snap terminal 31 are fixed to attachment part 13B. Elastic claw 30 formed on attachment part 13B is brought into contact with the inside of snap terminal 31. In this structure, elastic repulsion of snap terminal 31 can be increased.

Figure 21:
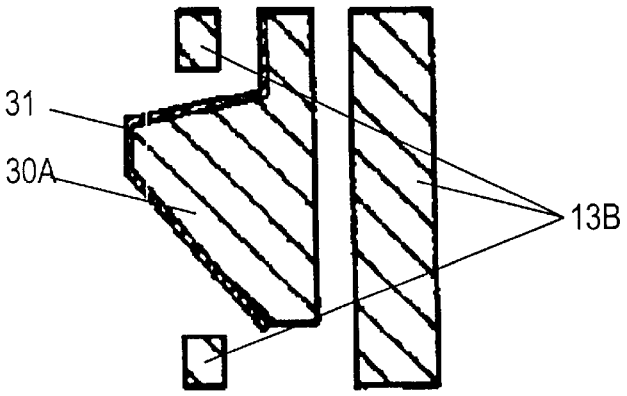
FIG. 21 is a fragmentary sectional view illustrating a state where the snap terminal and the elastic claw that are important parts of the antenna device shown in FIG. 17 are formed integrally.
Figure 22:
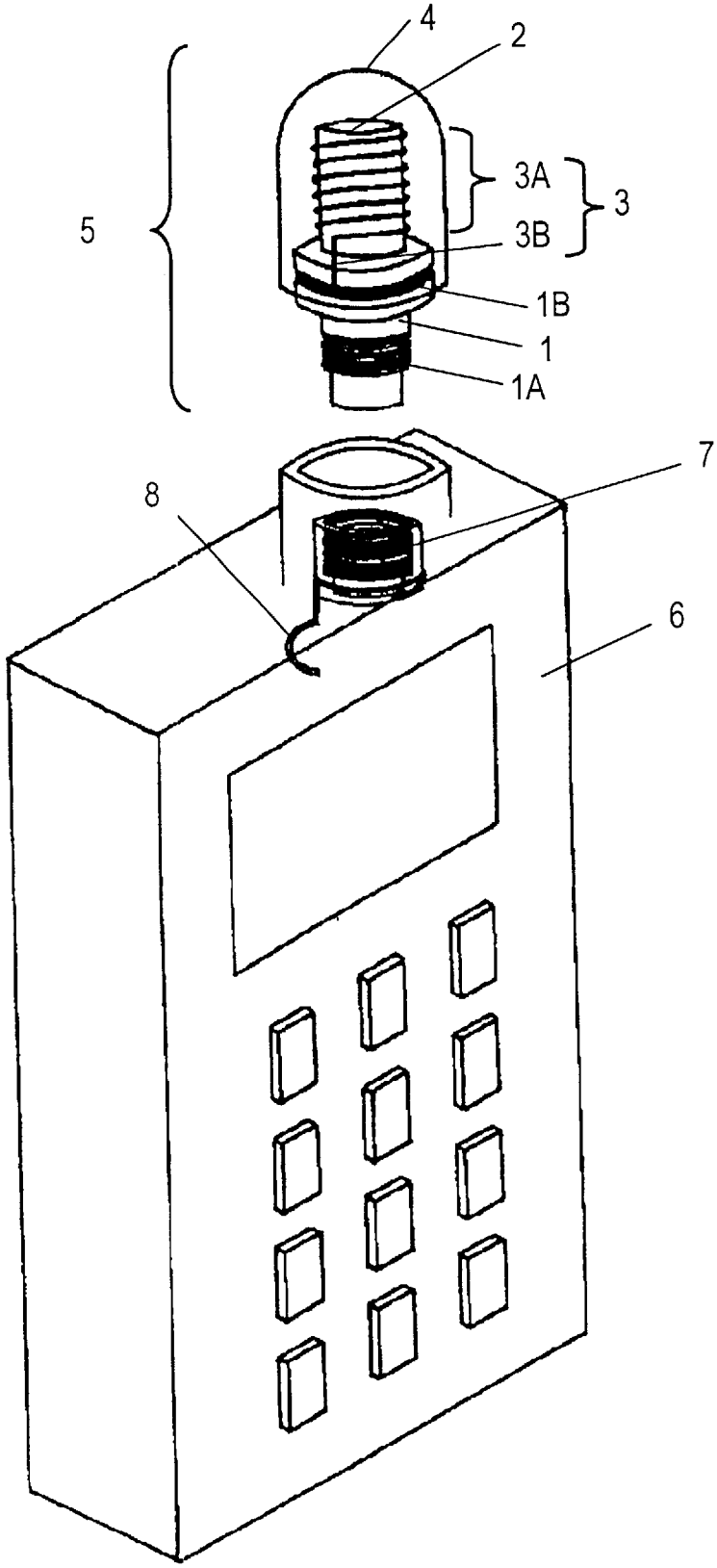
FIG. 22 is a perspective view illustrating a conventional antenna device and a mounting part of a radio machine.

FIG. 21 shows an example where the upper and lower parts of snap terminal 31 are not fixed to attachment part 13B. When snap terminal 31 and elastic claw 30A are integrally formed as shown by the sectional view in FIG. 21, positional accuracy of snap terminal 31 and elastic repulsion of snap terminal 31 can be increased.

In any antenna device described above, a top cover, a core part, and the attachment part are constituted by independent members. They are made of resins.

When the core part for holding the antenna element is formed and simultaneously the attachment part is integrally formed, the attachment part is integrally formed and simultaneously the top cover is integrally formed, or the core part for holding the antenna element is formed and simultaneously the top cover is integrally formed, at least one of processes for forming the antenna device using resin can be eliminated.

In the present invention, a light antenna device that can easily mount to a radio machine and can reduce loss of the induced high frequency current can be realized. The radio machine mounted with the antenna device is lightened and is highly sensitive.

What is claimed is:

1. An apparatus comprising an antenna device, said antenna device comprising:

a conductive antenna element;

a core part for holding said conductive antenna element, said core part being formed of insulating resin;

an attachment part formed of insulating resin, said attachment part being attachable to a radio device, said attachment part being disposed adjacent to said core part;

a top cover formed of insulating resin, said top cover covering said conductive antenna element and said core part;

a snap part projecting from said attachment part; and a connection terminal formed at said attachment part for electrically connecting said conductive antenna element to a circuit part of the radio device;

wherein said core part and said attachment part are unitarily formed with each other;

wherein said antenna element is held on said core part; and wherein said core part does not include a cavity therein.

2. The apparatus according to claim 1, wherein said snap part comprises a claw portion.

3. The apparatus according to claim 2, wherein said claw portion comprises metal.

4. The apparatus according to claim 2, wherein said claw portion comprises insulating resin embedded with metal.

5. The apparatus according to claim 2, further comprising:

said radio device;

wherein said claw portion is formed of insulating resin;

wherein said radio device farther comprises an engagement part; and wherein said claw portion is engaged with said engagement part of said radio device.

6. The apparatus according to claim 5, wherein one part of said connection terminal is embedded in said claw portion.

7. The apparatus according to claim 5, wherein said connection terminal has a first end and a second end, wherein said first end of said connection terminal is connected to said conductive antenna element, wherein said second end of said connection terminal is connected to the circuit part, and wherein a portion of said connection terminal is embedded in said attachment part.

8. The apparatus according to claim 1, wherein said snap part comprises a metal part, and wherein said metal part of said snap part and said connection terminal are unitarily formed with each other.

9. The apparatus according to claim 1, wherein said conductive antenna element and said connection terminal are unitarily formed with each other.

10. The apparatus according to claim 1, wherein said connection terminal and said conductive antenna element are coupled with each other by crimping, burring, welding, or soldering.

11. The apparatus according to claim 1, further comprising:

said radio device;

wherein said radio device further comprises an engagement part having a first shape;

wherein a portion of said connection terminal has a second shape; and wherein said second shape is complementary to said first shape.

12. The apparatus according to claim 1, wherein said core part, said attachment part and said snap part are unitarily formed with each other.

13. The apparatus according to claim 1, further comprising:

said radio device;

wherein said attachment part has a side-wall;

wherein said radio device further comprises a groove;

wherein said snap part projects from said side-wall of said attachment part; and wherein said snap part is fixed in said groove.

14. The apparatus according to claim 13, wherein said snap part is rotatably fixed in said groove.

15. The apparatus according to claim 1, wherein said snap part and said connection terminal are formed of metal, wherein said connection terminal has a first end and a second end, wherein said first end of said connection terminal is connected to said conductive antenna element, wherein said second end of said connection terminal is embedded in said first insulating resin, and wherein said snap part is fixable to the radio device.

16. The apparatus according to claim 1, wherein said core part has an external surface, and said conductive antenna element is fixedly mounted to said external surface of said core part.

17. The apparatus according to claim 1, wherein said conductive antenna element comprises a winding part, and wherein said winding part is spirally disposed on said outer surface of said core part.

18. The apparatus according to claim 17, wherein said winding part comprises a plurality of windings having a predetermined pitch.

19. An apparatus comprising an antenna device, said antenna device comprising:

a conductive antenna element;

a solid core part formed of insulating resin;

an attachment part formed of insulating resin, said attachment part being attachable to a radio device, said attachment part being disposed adjacent to said solid core part;

a top cover formed of insulating resin, said top cover covering said conductive antenna element and said solid core part;

a snap part projecting from said attachment part; and a connection terminal formed at said attachment part for electrically connecting said conductive antenna element to a circuit part of the radio device;

wherein said conductive antenna element is fixedly mounted to said solid core part.

20. An apparatus comprising an antenna device, said antenna device comprising:

a conductive antenna element;

a core part for holding said conductive antenna element, said core part formed of insulating resin, sail core part not having a cavity therein;

an attachment part formed of insulating resin, said attachment part being attachable to a radio device, said attachment part being disposed adjacent to said core part, said attachment part having a first end and a second end;

a top cover formed of insulating resin, said top cover covering said conductive antenna element and said core part;

a snap part integrally formed with said attachment part at said second end of said attachment part, said snap part being fixable to an engagement part of the radio device; and a connection terminal formed at said attachment part for electrically connecting said conductive antenna element to a circuit part of the radio device;

wherein said core part and said attachment part are unitarily formed with each other.

21. The apparatus according to claim 20, wherein said core part has an external surface, and said conductive antenna element is fixedly mounted to said external surface of said core part.

22. The apparatus according to claim 20, wherein said conductive antenna element and said connection terminal are unitarily formed with each other.

23. The apparatus according to claim 20, wherein said connection terminal and said conductive antenna element are coupled with each other by crimping, burring, welding, or soldering.

24. The apparatus according to claim 20, further comprising:

said radio device having said engagement part;

wherein said engagement part has a first shape;

wherein a portion of said connection terminal has a second shape; and wherein said second shape is complementary to said first shape.

25. The apparatus according to claim 20, wherein said snap part comprises two snap portions, wherein said connection terminal and said two snap portions are coplanar, and wherein said connection terminal and said two snap portions are disposed adjacent to said attachment part.

26. The apparatus according to claim 20, wherein said snap part is arranged for establishing a mounting position of said antenna device, with respect to the radio device.

27. The apparatus according to claim 20, wherein said snap part comprises a plurality of snap portions.

28. The apparatus according to claim 20, wherein said attachment part has a side surface, wherein said side surface comprises a projection, and wherein said projection is arranged for preventing a backlash of said attachment part.

29. The apparatus according to claim 20, wherein said attachment part has a side surface, wherein said side surface comprises a projection, and wherein said projection is arranged for preventing said antenna device from coming loose from the radio device.

30. An apparatus comprising an antenna device, said antenna device comprising:

a conductive antenna element;

a solid core part formed of insulating resin;

an attachment part formed of insulating resin, said attachment part being attachable to a radio device, said attachment part being disposed adjacent to said solid core part, said attachment part having a first end and a second end;

a top cover formed of insulating resin, said top cover covering said conductive antenna element and said solid core part;

a snap part integrally formed with said attachment part at said second end of said attachment part, said snap part being fixed to an engagement part of the radio device; and a connection terminal formed at said attachment part for electrically connecting said conductive antenna element to a circuit part of the radio device;

wherein said conductive antenna element is fixedly mounted to said solid core part.

31. An apparatus comprising an antenna device, said antenna device comprising:

a conductive antenna element;

a core part for holding said conductive antenna element, said core part being formed of insulating resin, said core part not having a cavity therein;

an attachment part formed of insulating resin, said attachment part being attachable to a radio device;

a top cover formed of insulating resin, said top cover covering said conductive antenna element and said core part; and a snap part having a metal part electrically connected to said antenna element and projecting from said attachment part;

wherein said attachment part and said core part are unitarily formed with one another;

wherein a portion of said metal part is exposed; and wherein the exposed metal part of said snap part is arranged for being electrically connected to a circuit part of the radio device.

32. The apparatus according to claim 31, wherein said snap part is fixed to a portion of said attachment part thereby providing reinforcement of said snap part.

33. The apparatus according to claim 31, wherein said snap part is arranged for establishing a mounting position of said antenna device, with respect to the radio device.

34. The apparatus according to claim 31, wherein said snap part comprises a plurality of snap portions.

35. The apparatus according to claim 31, wherein said attachment part has a side surface, wherein said side surface comprises a projection, and wherein said projection is arranged for preventing the antenna device from coming loose from the radio device.

36. The apparatus according to claim 31, wherein said core part has an external surface, and said conductive antenna element is fixedly mounted to said external surface of said core part.

37. An apparatus comprising an antenna device, said antenna device comprising:

a conductive antenna element;

a solid core part formed of insulating resin;

an attachment part formed of insulating resin, said attachment part being attachable to a radio device;

a top cover formed of insulating resin, said top cover covering said conductive antenna element and said solid core part; and a snap part having a metal part electrically connected to said antenna element and projecting from said attachment part;

wherein the exposed metal part of said snap part is arranged for being electrically connected to a circuit part of the radio device; and wherein said conductive antenna element is fixedly mounted to said solid core part.

* * * * *